US010580415B2

(12) United States Patent
Nagel et al.

(10) Patent No.: US 10,580,415 B2
(45) **Date of Patent: *Mar. 3, 2020**

(54) APPARATUS AND METHOD FOR GENERATING A BANDWIDTH EXTENDED SIGNAL FROM A BANDWIDTH LIMITED AUDIO SIGNAL

(71) Applicant: Fraunhofer-Gesellschaft zur Foerderung der angewandten Forschung e.V., Munich (DE)

(72) Inventors: Frederik Nagel, Nuremberg (DE); Stephan Wilde, Nuremberg (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/978,342

(22) Filed: May 14, 2018

(65) Prior Publication Data

US 2018/0261229 A1 Sep. 13, 2018

Related U.S. Application Data

(63) Continuation of application No. 14/659,911, filed on Mar. 17, 2015, now Pat. No. 9,997,162, which is a (Continued)

(30) Foreign Application Priority Data

Sep. 17, 2012 (EP) ..... 12184706

(51) Int. Cl.
*G10L 19/00* (2013.01)
*G10L 19/025* (2013.01)
(Continued)

(52) U.S. Cl.
CPC ..... *G10L 19/00* (2013.01); *G10L 19/008* (2013.01); *G10L 19/025* (2013.01); *G10L 21/038* (2013.01); *G10L 19/0208* (2013.01)

(58) Field of Classification Search
CPC ... G10L 21/038; G10L 19/025; G10L 19/008; G10L 19/0208; G10L 19/20; G10L 21/04;
(Continued)

(56) References Cited

U.S. PATENT DOCUMENTS 5,455,888 A 10/1995 Iyengar et al.
5,940,429 A 8/1999 Lam et al.
(Continued)

FOREIGN PATENT DOCUMENTS

AU 2009267433 B 1/2010
CN 1504993 A 6/2004
(Continued)

OTHER PUBLICATIONS

S. Meltzer, R. Böhm and F. Henn, "SBR enhanced audio codecs for digital broadcasting such as "Digital Radio Mondiale" (DRM)," in 112th AES Convention, Munich, May 2002.
(Continued)

*Primary Examiner* — Vijay B Chawan
(74) *Attorney, Agent, or Firm* — McClure, Qualey & Rodack, LLP

(57) ABSTRACT

An apparatus for generating a bandwidth extended signal from a bandwidth limited audio signal, the bandwidth limited audio signal The patch generator is configured to perform a harmonic patching algorithm to obtain the patched signal. The signal manipulator is configured for manipulating a signal before patching or the patched signal. The timely preceding bandwidth limited time block timely precedes the current bandwidth limited time block in the plurality of consecutive bandwidth limited time blocks of the bandwidth
(Continued)

limited audio signal. The combiner is configured for combining the bandwidth limited audio signal having the core frequency band and the manipulated patched signal having the upper frequency band to obtain the bandwidth extended signal.

16 Claims, 17 Drawing Sheets

Related U.S. Application Data continuation of application No. PCT/EP2013/068808, filed on Sep. 11, 2013.

(51) Int. Cl.
*G10L 19/008* (2013.01)
*G10L 21/038* (2013.01)
*G10L 19/02* (2013.01)

(58) Field of Classification Search
CPC ... G10L 19/02; G10L 19/0204; G10L 19/022; G10L 19/18; G10L 19/24; G10L 19/265; G10L 21/007
USPC ..... 704/500–504, 200.1, 205, 219, 220; 381/97, 56
See application file for complete search history.

(56) References Cited

U.S. PATENT DOCUMENTS

| | | | | |
|---|---|---|---|---|
| 6,118,879 | A | 9/2000 | Hanna | |
| 6,549,884 | B1 | 4/2003 | Laroche et al. | |
| 6,895,375 | B2 | 5/2005 | Malah et al. | |
| 7,283,955 | B2 * | 10/2007 | Liljeryd | G10L 21/038 704/219 |
| 8,290,783 | B2 * | 10/2012 | Schnell | G10L 19/008 704/200.1 |
| 8,612,214 | B2 * | 12/2013 | Neuendorf | G10L 19/0208 704/200 |
| 9,076,433 | B2 * | 7/2015 | Nagel | G10L 19/18 |
| 9,159,337 | B2 * | 10/2015 | Villemoes | G10L 21/038 |
| 9,997,162 | B2 * | 6/2018 | Nagel | G10L 21/038 |
| 2004/0107090 | A1 | 6/2004 | Oh et al. | |
| 2009/0226010 | A1 | 9/2009 | Schnell et al. | |
| 2010/0094638 | A1 | 4/2010 | Lee et al. | |
| 2011/0046965 | A1 | 2/2011 | Taleb et al. | |
| 2011/0202352 | A1 * | 8/2011 | Neuendorf | G10L 19/0208 704/500 |
| 2012/0010880 | A1 | 1/2012 | Nagel et al. | |
| 2012/0076323 | A1 * | 3/2012 | Disch | G10L 19/025 381/97 |
| 2012/0136670 | A1 * | 5/2012 | Ishikawa | G10L 21/038 704/500 |
| 2012/0158409 | A1 * | 6/2012 | Nagel | G10L 19/0208 704/500 |
| 2012/0209597 | A1 | 8/2012 | Yamanashi | |
| 2012/0281859 | A1 | 11/2012 | Villemoes et al. | |
| 2013/0051571 | A1 * | 2/2013 | Nagel | G10L 19/0204 381/56 |
| 2013/0058498 | A1 * | 3/2013 | Disch | G10L 21/038 381/97 |

FOREIGN PATENT DOCUMENTS

| | | | |
|---|---|---|---|
| CN | 1629937 | A | 6/2005 |
| CN | 102105931 | A | 6/2011 |
| CN | 102177545 | A | 9/2011 |
| CN | 102473414 | A | 5/2012 |
| CN | 102598123 | A | 7/2012 |
| CN | 102648495 | A | 8/2012 |
| EP | 2 234 103 | | 9/2010 |
| EP | 2 239 732 | A | 10/2010 |
| RU | 2 407 069 | C2 | 12/2008 |
| RU | 2 443 028 | C2 | 9/2011 |
| RU | 2 455 710 | C2 | 2/2012 |
| WO | 98/57436 | A | 12/1998 |
| WO | 2002/058052 | A1 | 7/2002 |
| WO | 2010/003557 | A | 1/2010 |
| WO | 2010/069885 | A | 6/2010 |
| WO | 2011/030354 | A2 | 3/2011 |
| WO | 2011/110499 | A1 | 9/2011 |
| WO | 2011/110500 | A | 9/2011 |

OTHER PUBLICATIONS

R. M. Aarts, E. Larsen, and 0. Ouweltjes. A unified approach to low- and high frequency bandwidth extension. In AES 115th Convention, New York, USA, Oct. 2003; pp. 1-16.

E. Larsen and R. M. Aarts. Audio Bandwidth Extension—Application to psychoacoustics, Signal Processing 35 and Loudspeaker Design. John Wiley & Sons, Ltd, 2004; pp. 1-32.

E. Larsen, R. M. Aarts, and M. Danessis. Efficient high-frequency bandwidth extension of music and speech. In AES 112th Convention, Munich, Germany, May 2002; pp. 1-5.

J. Makhoul. Spectral Analysis of Speech by Linear Prediction. IEEE Transactions on Audio and Electroacoustics, AU-21(3), Jun. 1973; pp. 1-9.

T. Ziegler, A. Ehret, P. Ekstrand and M. Lutzky, "Enhancing mp3 with SBR: Features and Capabilities of the new mp3PRO Algorithm," in 112th AES Convention, Munich, May 2002; pp. 1-7.

International Standard ISO/IEC 14496-15 3:2001/FPDAM 1, "Bandwidth Extension," ISO/IEC, 2002.

Laroche L., Dolson M.: "Improved phase vocoder timescale modification of audio", IEEE Trans. Speech and Audio Processing, vol. 7, No. 3, pp. 323-332.

Laroche, J. & Dolson, M.: "New Phase-Vocoder Techniques for Pitch-Shifting, Harmonizing and Other Exotic Effects"; IEEE Workshop on Applications of Signal Processing to Audio and Acoustics, New Paltz, New York, Oct. 17-20, 1999; pp. 1-4.

Frederik Nagel, Sascha Disch, Nikolaus Rettelbach, "A phase vocoder driven bandwidth extension method with novel transient handling for audio codecs," 126th AES Convention , Munich, Germany, May 2009; pp. 1-8.

M. Dietz, L. Liljeryd, K. Kjörling and 0. Kunz, "Spectral Band Replication, a novel approach in audio coding," in 112th AES Convention, Munich, May 2002; pp. 1-8.

M. Puckette: "Phase-locked Vocoder", IEEE ASSP Conference on Applications of Signal Processing to Audio and Acoustics, Mohonk 1995; pp. 1-4.

Neuendorf, Max; et al.: Unified Speech and Audio Coding Scheme for High Quality at Lowbitrates, ICASSP 2009, Apr. 19-24, 2009, Taipei, Taiwan; pp. 1-4.

Bayer, Stefan; et al.: A Novel Scheme for Low Bitrate Unified Speech and Audio Coding, 126th AES Convention, May 7, 2009, Munich; pp. 1-13.

A. Röbel: Transient Detection and preservation in the phase vocoder; citeseer.ist.psu.edu/679246.html; pp. 1-4.

K. Käyhkö. A Robust Wideband Enhancement for Narrowband Speech Signal. Research Report, Helsinki University of Technology, Laboratory of Acoustics and Audio Signal Processing, 2001. (not provided).

Frederik Nagel et al. "A harmonic bandwidth extension method for audio codecs" Acoustics, Speech and Signal Processing, 2009. ICASSP 2009, IEEE International Conference on, IEEE, Piscataway, NJ, USA, Apr. 19, 2009, pp. 145-148.

International Search Report for PCT/EP2013/068808 dated Mar. 12, 2013.

Acoustic Signal Encoding combining Speech and Musical Tone, Academic Journal of Acoustical Society of Japan, vol. 68, No. 3, Mar. 1, 2012.

Office Action issued in corresponding Japan patent application dated Jun. 28, 2016.

Office Action issued in corresponding Russia patent application No. 2015113983 dated Jun. 17, 2016.

(56) References Cited

OTHER PUBLICATIONS

Decision to Grant issued in corresponding Korean patent application No. 10-2015-7009438 dated Dec. 21, 2016 (and it's English translation).
ISO/IEC JTC1/SC29/WG11, "FDIS 23003-3:2011(E), Information technology MPEG audio technologies, Part 3: Unified speech and audio coding," Sep. 20, 2011.
Hsu, Han-Wen, et al. "Audio patch method in MPEG-4 HE AAC decoder." Audio Engineering Society Convention 117. Audio Engineering Society, 2004. http://www.aes.org/e-lib/browse.cfm?elib=12878.
Chinese language office action dated Jan. 3, 2017, issued in application No. CN 2016122802109350.
English language translation of Chinese office action.
Nagel, F.et al; "A harmonic bandwith extension method for audio codecs;" IEEE International Conference on, IEEE Piscataway; 2009; pp. 145-148.

* cited by examiner

APPARATUS AND METHOD FOR GENERATING A BANDWIDTH EXTENDED SIGNAL FROM A BANDWIDTH LIMITED AUDIO SIGNAL

CROSS-REFERENCE TO RELATED APPLICATIONS

This application is a continuation of U.S. patent application Ser. No. 14/659,911, filed on Mar. 17, 2015, which is a continuation of International Application No. PCT/EP2013/068808, filed Sep. 11, 2013, both of which are incorporated herein by reference in their entireties, and additionally claims priority from European Application No. 12184706.5, filed Sep. 17, 2012, which is also incorporated herein by reference in its entirety.

BACKGROUND OF THE INVENTION

The present invention relates to audio signal processing and, in particular, to an apparatus and a method for generating a bandwidth extended signal from a bandwidth limited audio signal.

Storage or transmission of audio signals is often subject to strict bitrate constraints. In the past, coders were forced to drastically reduce the transmitted audio bandwidth when only a very low bitrate was available. Modern audio codecs are nowadays able to code wideband signals by using bandwidth extension (BWE) methods as described in M. Dietz, L. Liljeryd, K. Kjörling and O. Kunz, "Spectral Band Replication, a novel approach in audio coding," in 112th AES Convention, Munich, May 2002; S. Meltzer, R. Böhm and F. Henn, "SBR enhanced audio codecs for digital broadcasting such as "Digital Radio Mondiale" (DRM)," in 112$^{th}$ AES Convention, Munich, May 2002; T. Ziegler, A. Ehret, P. Ekstrand and M. Lutzky, "Enhancing mp3 with SBR: Features and Capabilities of the new mp3PRO Algorithm," in 112$^{th}$ AES Convention, Munich, May 2002; International Standard ISO/IEC 14496-3:2001/FPDAM 1, "Bandwidth Extension," ISO/IEC, 2002. Speech bandwidth extension method and apparatus, Vasu Iyengar et al; E. Larsen, R. M. Aarts, and M. Danessis. Efficient high-frequency bandwidth extension of music and speech. In AES 112th Convention, Munich, Germany, May 2002; R. M. Aarts, E. Larsen, and O. Ouweltjes. A unified approach to low- and high frequency bandwidth extension. In AES 115th Convention, New York, USA, October 2003; K. Käyhkö. A Robust Wideband Enhancement for Narrowband Speech Signal. Research Report, Helsinki University of Technology, Laboratory of Acoustics and Audio Signal Processing, 2001; E. Larsen and R. M. Aarts. Audio Bandwidth Extension—Application to psychoacoustics, Signal Processing and Loudspeaker Design. John Wiley & Sons, Ltd, 2004; E. Larsen, R. M. Aarts, and M. Danessis. Efficient high-frequency bandwidth extension of music and speech. In AES 112th Convention, Munich, Germany, May 2002; J. Makhoul. Spectral Analysis of Speech by Linear Prediction. IEEE Transactions on Audio and Electroacoustics, AU-21 (3), June 1973; U.S. patent application Ser. No. 08/951,029, Ohmori, et al., Audio band width extending system and method; and U.S. Pat. No. 6,895,375, Malah, D & Cox, R. V.: System for bandwidth extension of Narrow-band speech. These algorithms rely on a parametric representation of the high-frequency content (HF) which is generated from the low-frequency part (LF) of the decoded signal by means of transposition into the HF spectral region ("patching") and application of a parameter driven post processing. The LF part is coded with any audio or speech coder. For example, the bandwidth extension methods described in M. Dietz, L. Liljeryd, K. Kjörling and O. Kunz, "Spectral Band Replication, a novel approach in audio coding," in 112th AES Convention, Munich, May 2002; S. Meltzer, R. Böhm and F. Henn, "SBR enhanced audio codecs for digital broadcasting such as "Digital Radio Mondiale" (DRM)," in 112$^{th}$ AES Convention, Munich, May 2002; T. Ziegler, A. Ehret, P. Ekstrand and M. Lutzky, "Enhancing mp3 with SBR: Features and Capabilities of the new mp3PRO Algorithm," in 112$^{th}$ AES Convention, Munich, May 2002; and International Standard ISO/IEC 14496-3:2001/FPDAM 1, "Bandwidth Extension," ISO/IEC, 2002. Speech bandwidth extension method and apparatus, Vasu Iyengar et al., rely on single sideband modulation (SSB), often also termed the "copy-up" method, for generating the multiple HF patches.

Lately, a new algorithm, which employs a bank of phase vocoders as described in M. Puckette. Phase-locked Vocoder. IEEE ASSP Conference on Applications of Signal Processing to Audio and Acoustics, Mohonk 1995.", Röbel, A.: Transient detection and preservation in the phase vocoder; citeseer.ist.psu.edu/679246.html; Laroche L., Dolson M.: "Improved phase vocoder timescale modification of audio", IEEE Trans. Speech and Audio Processing, vol. 7, no. 3, pp. 323-332; U.S. Pat. No. 6,549,884, Laroche, J. & Dolson, M.: Phase-vocoder pitch-shifting, for the generation of the different patches, has been presented as described in Frederik Nagel, Sascha Disch, "A harmonic bandwidth extension method for audio codecs," ICASSP International Conference on Acoustics, Speech and Signal Processing, IEEE CNF, Taipei, Taiwan, April 2009. This method has been developed to avoid the auditory roughness which is often observed in signals subjected to SSB bandwidth extension. Albeit being beneficial for many tonal signals, this method called "harmonic bandwidth extension" (HBE) is prone to quality degradations of transients contained in the audio signal as described in Frederik Nagel, Sascha Disch, Nikolaus Rettelbach, "A phase vocoder driven bandwidth extension method with novel transient handling for audio codecs," 126th AES Convention, Munich, Germany, May 2009, since vertical coherence over sub-bands is not guaranteed to be preserved in the standard phase vocoder algorithm and, moreover, the re-calculation of the phases has to be performed on time blocks of a transform or, alternatively of a filterbank. Therefore, a need arises for a special treatment for signal parts containing transients. Additionally, the overlap add based phase vocoders applied in the HBE algorithm cause additional delay which is too high to be acceptable for use in applications designed for communication purposes.

As outlined above, existing bandwidth extension schemes may apply one patching method on a given signal block at a time, be it SSB based patching as described in M. Dietz, L. Liljeryd, K. Kjörling and O. Kunz, "Spectral Band Replication, a novel approach in audio coding," in 112th AES Convention, Munich, May 2002; S. Meltzer, R. Böhm and F. Henn, "SBR enhanced audio codecs for digital broadcasting such as "Digital Radio Mondiale" (DRM)," in 112$^{th}$ AES Convention, Munich, May 2002; T. Ziegler, A. Ehret, P. Ekstrand and M. Lutzky, "Enhancing mp3 with SBR: Features and Capabilities of the new mp3PRO Algorithm," in 112$^{th}$ AES Convention, Munich, May 2002; and International Standard ISO/IEC 14496-3:2001/FPDAM 1, "Bandwidth Extension," ISO/IEC, 2002. Speech bandwidth extension method and apparatus, Vasu Iyengar et al., or HBE vocoder based patching explained in Frederik Nagel, Sascha Disch, "A harmonic bandwidth extension method for audio codecs," in ICASSP International Conference on Acoustics, Speech and Signal Processing, IEEE CNF, Taipei, Taiwan, April 2009. based on phase vocoder techniques as described in M. Puckette. Phase-locked Vocoder. IEEE ASSP Conference on Applications of Signal Processing to Audio and Acoustics, Mohonk 1995.", Röbel, A.: Transient detection and preservation in the phase vocoder; citeseer.ist.psu.edu/679246.html; Laroche L., Dolson M.: "Improved phase vocoder timescale modification of audio", IEEE Trans. Speech and Audio Processing, vol. 7, no. 3, pp. 323-332; U.S. Pat. No. 6,549,884, Laroche, J. & Dolson, M.: Phase-vocoder pitch-shifting.

Alternatively, a combination of HBE and SSB based patching can be used as described in US Provisional 61/312,127. Additionally, modern audio coders as described in Neuendorf, Max; Gournay, Philippe; Multrus, Markus; Lecomte, Jérémie; Bessette, Bruno; Geiger, Ralf; Bayer, Stefan; Fuchs, Guillaume; Hilpert, Johannes; Rettelbach, Nikolaus; Salami, Redwan; Schuller, Gerald; Lefebvre, Roch; Grill, Bernhard: Unified Speech and Audio Coding Scheme for High Quality at Lowbitrates, ICASSP 2009, Apr. 19-24, 2009, Taipei, Taiwan; Bayer, Stefan; Bessette, Bruno; Fuchs, Guillaume; Geiger, Ralf; Gournay, Philippe; Grill, Bernhard; Hilpert, Johannes; Lecomte, Jérémie; Lefebvre, Roch; Multrus, Markus; Nagel, Frederik; Neuendorf, Max; Rettelbach, Nikolaus; Robilliard, Julien; Salami, Redwan; Schuller, Gerald: A Novel Scheme for Low Bitrate Unified Speech and Audio Coding, 126th AES Convention, May 7, 2009, Munich, offer the possibility of switching the patching method globally on a time block basis between alternative patching schemes.

Conventional SSB copy-up patching has a disadvantage that it introduces unwanted roughness into the audio signal. However, it is computationally simple and preserves the time envelope of transients.

In audio codecs employing HBE patching, a disadvantage is that the transient reproduction quality is often suboptimal. Moreover, the computational complexity is significantly increased over the computational very simple SSB copy-up method. Additionally, HBE patching introduces additional algorithmic delay which exceeds the acceptable range for application in communication scenarios.

A further disadvantage of the state-of-the-art processing is that the combination of HBE and SSB based patching within one time block does not eliminate the additional delay caused by HBE.

It is an object of the present invention to provide a concept for generating a bandwidth extended signal from a bandwidth limited audio signal allowing an improved perceptual quality avoiding such disadvantages.

SUMMARY

According to an embodiment, an apparatus for generating a bandwidth extended signal from a bandwidth limited audio signal may have a patch generator, a signal manipulator and a combiner. The bandwidth limited audio signal has a plurality of consecutive bandwidth limited time blocks, each bandwidth limited time block having at least one associated spectral band replication parameter having a core frequency band. The bandwidth extended signal has a plurality of consecutive bandwidth extended time blocks. The patch generator is configured for generating a patched signal having an upper frequency band using a bandwidth limited time block of the bandwidth limited audio signal. The patch generator is configured to perform a harmonic patching algorithm to obtain the patched signal. The patch generator is configured to perform the harmonic patching algorithm for a current bandwidth extended time block of the plurality of consecutive bandwidth extended time blocks using a timely preceding bandwidth limited time block of the plurality of consecutive bandwidth limited time blocks of the bandwidth limited audio signal. The signal manipulator is configured for manipulating a signal before patching or the patched signal generated using the timely preceding bandwidth limited time block using a spectral band replication parameter associated with a current bandwidth limited time block to obtain a manipulated patched signal having the upper frequency band. The timely preceding bandwidth limited time block timely precedes the current bandwidth limited time block in the plurality of consecutive bandwidth limited time blocks of the bandwidth limited audio signal. The combiner is configured for combining the bandwidth limited audio signal having the core frequency band and the manipulated patched signal having the upper frequency band to obtain the bandwidth extended signal.

According to another embodiment, a method for generating a bandwidth extended signal from a bandwidth limited audio signal, the bandwidth limited audio signal having a plurality of consecutive bandwidth limited time blocks each bandwidth limited time block having at least one associated spectral band replication parameter having a core frequency band and the bandwidth extended signal having a plurality of consecutive bandwidth extended time blocks, may have the steps of: generating a patched signal having an upper frequency band using a bandwidth limited time block of the bandwidth limited audio signal; performing a harmonic patching algorithm to obtain the patched signal; performing the harmonic patching algorithm for a current bandwidth extended time block of the plurality of consecutive bandwidth extended time blocks using a timely preceding bandwidth limited time block of the plurality of consecutive bandwidth limited time blocks of the bandwidth limited audio signal; manipulating a signal before patching or the patched signal generated using the timely preceding bandwidth limited time block using a spectral band replication parameter associated with a current bandwidth limited time block to obtain a manipulated patched signal having the upper frequency band; wherein the timely preceding bandwidth limited time block timely precedes the current bandwidth limited time block in the plurality of consecutive bandwidth limited time blocks of the bandwidth limited audio signal; and combining the bandwidth limited audio signal having the core frequency band and the manipulated patched signal having the upper frequency band to obtain the bandwidth extended signal.

Another embodiment may have a computer program having a program code for performing the method mentioned above, when the computer program is executed on a computer.

The basic idea underlying the present invention is that the just-mentioned improved perceptual quality can be achieved if a patched signal comprising an upper frequency band is generated using a bandwidth limited time block of the bandwidth limited audio signal, a harmonic patching algorithm is performed to obtain the patched signal, the harmonic patching algorithm is performed for a current bandwidth extended time block of a plurality of consecutive bandwidth extended time blocks using a timely preceding bandwidth limited time block of a plurality of consecutive bandwidth limited time blocks of the bandwidth limited audio signal, and if a signal before patching or the patched signal is manipulated using a spectral band replication parameter associated with a current bandwidth limited time block to obtain a manipulated patched signal comprising the upper frequency band, wherein the timely preceding bandwidth limited time block timely precedes the current bandwidth limited time block in the plurality of consecutive bandwidth limited time blocks of the bandwidth limited audio signal. In this way, it is possible to avoid a negative impact of the additional delay caused by the HBE algorithm on the bandwidth extended signal. Therefore, the perceptual quality of the bandwidth extended signal can significantly be improved.

According to an embodiment, the patch generator is configured for performing the harmonic patching algorithm using an overlap add processing between at least two bandwidth limited time blocks. By using the overlap add processing, an additional delay is introduced into the harmonic patching algorithm.

Furthermore, embodiments of the present invention relate to a concept for improving the perceptual quality of stationary parts of audio signals without effecting transients. In order to fulfill both requirements, a scheme that applies a mixed patching consisting of harmonic patching and copy-up patching can be introduced.

Some embodiments according to the invention provide a better perceptual quality than conventional HBE which introduces additional algorithmic delay compared to the SSB. This can be compensated in this invention by exploiting the stationarity of the signal using frames from the past for generating the high frequency content for the harmonic signals.

BRIEF DESCRIPTION OF THE DRAWINGS

In the following, embodiments of the present invention will be explained with reference to the accompanying drawings in which.

DETAILED DESCRIPTION OF THE INVENTION

Figure 1:
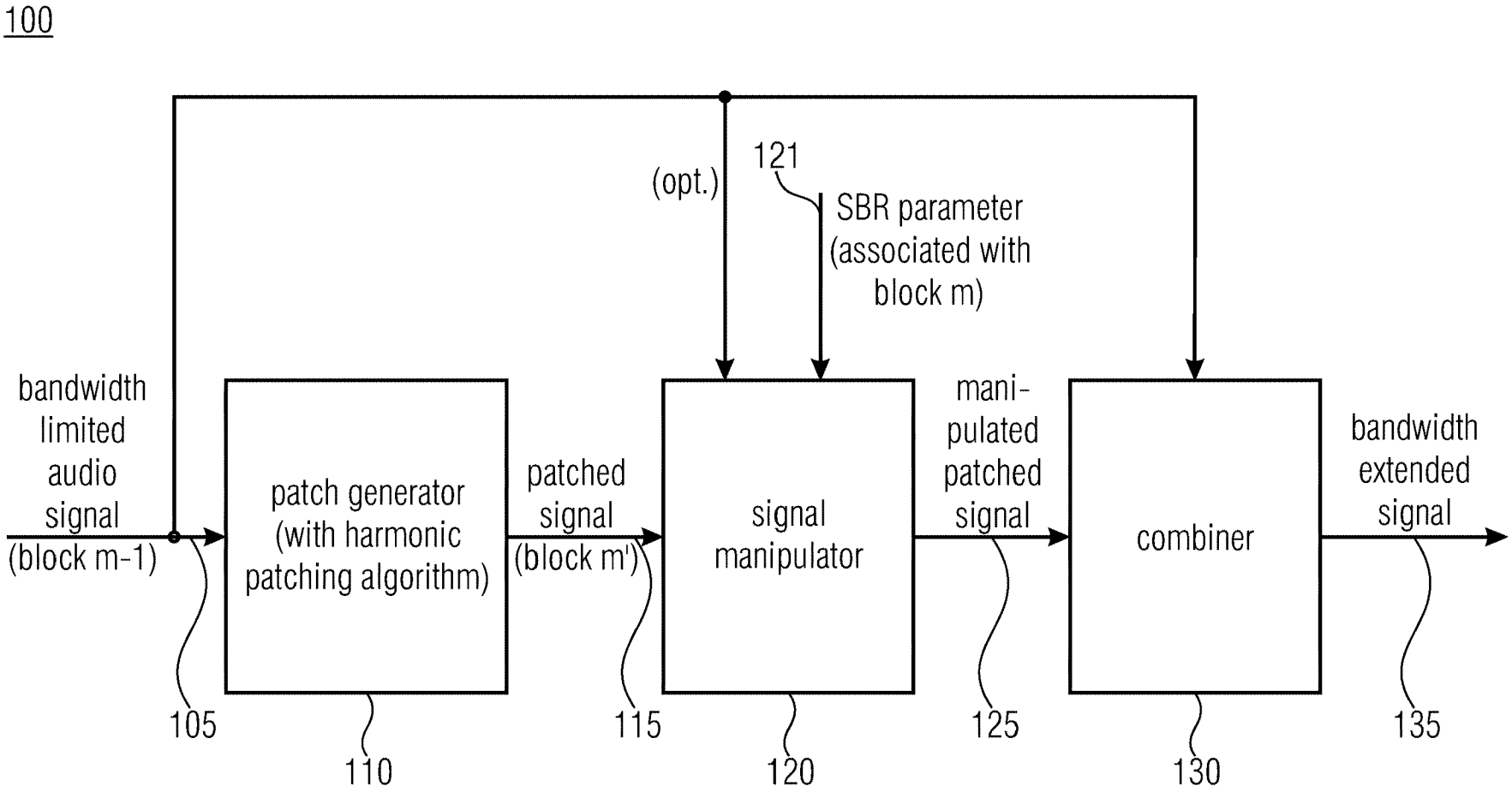
FIG. 1 shows a block diagram of an embodiment of an apparatus for generating a bandwidth extended signal from a bandwidth limited audio signal.

FIG. 1 shows a block diagram of an embodiment of an apparatus 100 for generating a bandwidth extended signal 135 from a bandwidth limited audio signal 105. Here, the bandwidth limited audio signal 105 comprises a plurality of consecutive bandwidth limited time blocks, each bandwidth limited time block having at least one associated spectral band replication parameter 121 comprising a core frequency band. Moreover, the bandwidth extended signal 135 comprises a plurality of consecutive bandwidth extended time blocks. As shown in FIG. 1, the apparatus 100 comprises a patch generator 110, a signal manipulator 120 and a combiner 130. The patch generator 110 is configured for generating a patched signal 115 comprising an upper frequency band using a bandwidth limited time block of the bandwidth limited audio signal 105. In the embodiment of FIG. 1, the patch generator 110 is configured to perform a harmonic patching algorithm to obtain the patched signal 115. For example, the patch generator 110 is configured to perform the harmonic patching algorithm for a current bandwidth extended time block (m') of the plurality of consecutive bandwidth extended time blocks using a timely preceding bandwidth limited time block (m−1) of the plurality of consecutive bandwidth limited time blocks of the bandwidth limited audio signal 105. As exemplarily depicted in FIG. 1, the signal manipulator 120 is configured for manipulating a signal 105 before patching (optional) or the patched signal 115 generated using the timely preceding bandwidth limited time block (m−1) using a spectral band replication (SBR) parameter 121 associated with a current bandwidth limited time block (m) to obtain a manipulated patched signal 125 comprising the upper frequency band. In the embodiment of FIG. 1, the timely preceding bandwidth limited time block (m−1) timely precedes the current bandwidth limited time block (m) in the plurality of consecutive bandwidth limited time blocks of the bandwidth limited audio signal 105. The combiner 130 is configured for combining the bandwidth limited audio signal 105 comprising the core frequency band and the manipulated patched signal 125 comprising the upper frequency band to obtain the bandwidth extended signal 135.

Referring to the embodiment of FIG. 1, the index m may correspond to an individual bandwidth limited time block of the plurality of consecutive bandwidth limited time blocks of the bandwidth limited audio signal 105, while the index m' may correspond to an individual bandwidth extended time block of the plurality of consecutive bandwidth extended time blocks obtained from the patch generator 110.

For example, the patch generator 110 shown in the embodiment of FIG. 1 uses a DFT based harmonic transposer or a QMF based harmonic transposer such as described in sections 7.5.3 and 7.5.4 of the MPEG audio standard ISO/IEC FDIS 23003-3, 2011, respectively.

In embodiments, the signal manipulator 120 may comprise an envelope adjuster for adjusting the envelope of the patched signal 115 in dependence on the SBR parameter 121 to obtain an envelope adjusted or manipulated patched signal 125.

Figure 2:
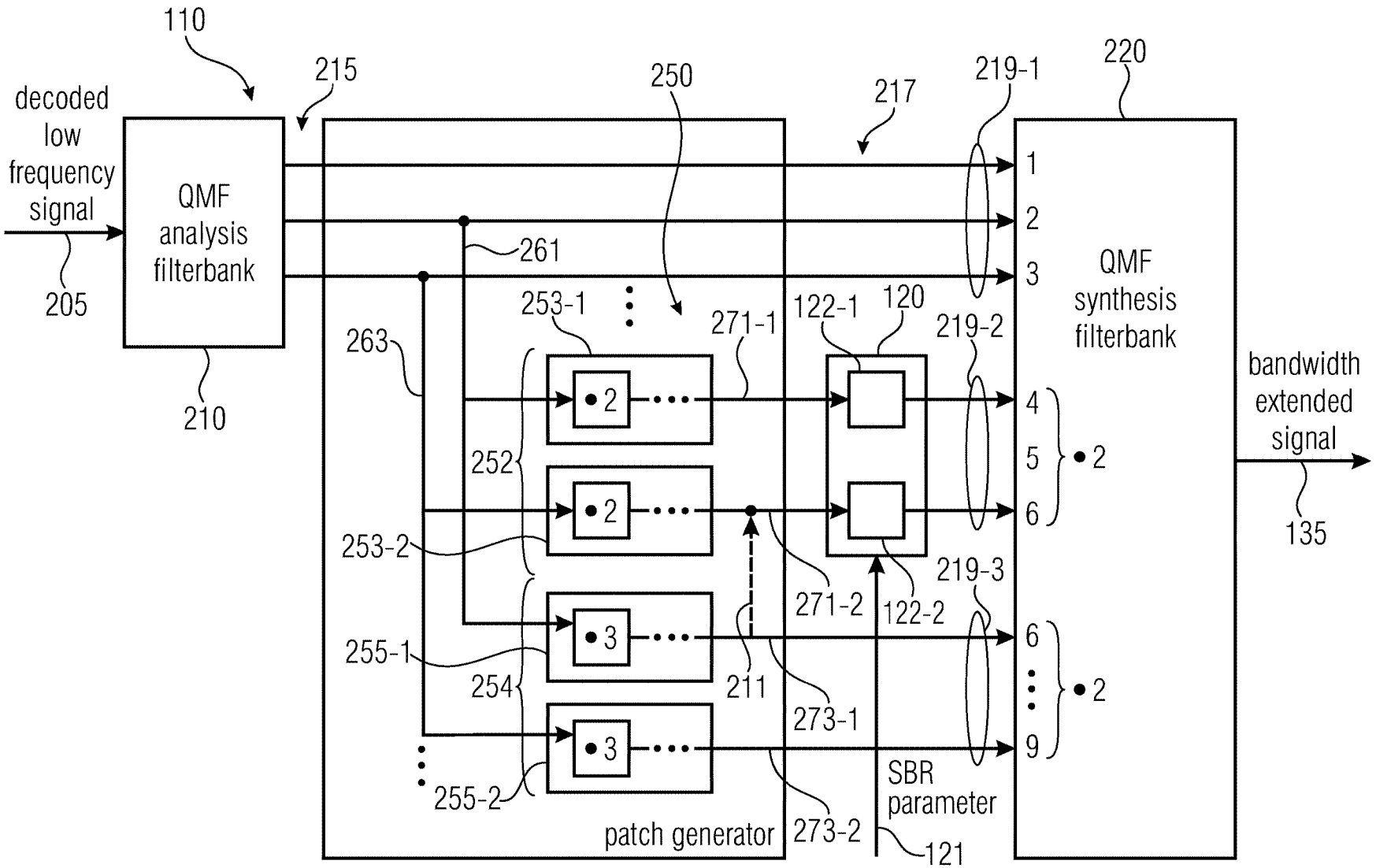
FIG. 2 shows a block diagram of an embodiment of a patch generator for performing a harmonic patching algorithm in a filterbank domain.

FIG. 2 shows a block diagram of an embodiment of a patch generator 110 of the embodiment of the apparatus 100 in accordance with FIG. 1 for performing a harmonic patching algorithm in a filterbank domain. Referring to FIG. 2, the apparatus 100 may comprise a QMF analysis filterbank 210, the embodiment of the patch generator 110 and a QMF synthesis filterbank 220.

For example, the QMF analysis filterbank 210 is configured for converting a decoded low frequency signal 205 into a plurality 215 of frequency subband signals. The plurality 215 of frequency subband signals shown in FIG. 2 may represent the core frequency band of the bandwidth limited audio signal 105 shown in FIG. 1.

In the embodiment of FIG. 2, the patch generator 110 is configured to be operative on the plurality 215 of frequency subband signals provided by the QMF analysis filterbank 210 and outputs a plurality 217 of patched frequency subband signals for the QMF synthesis filterbank 220. The plurality 217 of patched frequency subband signals shown in FIG. 2 may represent the patched signal 115 shown in FIG. 1.

The QMF synthesis filterbank 220 is, for example, configured for converting the plurality 217 of patched frequency subband signals into the bandwidth extended signal 135.

Referring to the embodiment of FIG. 2, the patched frequency subband signals 217 received by the QMF synthesis filterbank 220 are denoted by "1", "2", "3", . . . , representing different patched frequency subband signals characterized by increasingly higher frequencies.

As exemplarily depicted in FIG. 2, the patch generator 110 is configured for obtaining a first group 219-1 of patched frequency subband signals, a second group 219-2 of patched frequency subband signals and a third group 219-3 of patched frequency subband signals from the plurality 215 of frequency subband signals. For example, the patch generator 110 is configured to directly feed the first group 219-1 of patched frequency subband signals from the QMF analysis filterbank 210 to the QMF synthesis filterbank 220. It is also exemplarily depicted in FIG. 2 that the patch generator 110 comprises a plurality 250 of non-linear processing blocks.

The plurality 250 of non-linear processing blocks may comprise a first group 252 of non-linear processing blocks and a second group 254 of non-linear processing blocks. For example, the first group 252 of non-linear processing blocks of the patch generator 110 is configured for performing a non-linear processing to obtain the second group 219-2 of patched frequency subband signals. In addition, the second group 254 of non-linear processing blocks of the patch generator 110 may be configured for performing a non-linear processing to obtain the third group 219-3 of patched frequency subband signals. In the embodiment of FIG. 2, the first group 252 of non-linear processing blocks comprises a first non-linear processing block 253-1 and a second non-linear processing block 253-2, while the second group 254 of non-linear processing blocks comprises a first non-linear processing block 255-1 and a second non-linear processing block 255-2.

For example, the first non-linear processing block 253-1 and the second non-linear processing block 253-2 of the first group 252 of non-linear processing blocks are configured to perform the non-linear processing in that phases of a first higher frequency subband signal 261 and a second higher frequency subband signal 263 are multiplied by a bandwidth extension factor (□) of two to obtain corresponding non-linear processed output signals 271-1, 271-2, respectively. In addition, the first non-linear processing block 255-1 and the second non-linear processing block 255-2 of the second group 254 of non-linear processing blocks may be configured to perform the non-linear processing in that phases of the first higher frequency subband signal 261 and the second higher frequency subband signal 263 are multiplied by a bandwidth extension factor (□) of three to obtain corresponding non-linear processed output signals 273-1, 273-2, respectively.

The non-linear processed output signals 271-1, 271-2 output by the first non-linear processing block 253-1 and the second non-linear processing block 253-2 may be manipulated by corresponding signal manipulation blocks 122-1, 122-2 of a signal manipulator 120, respectively. As exemplarily depicted in FIG. 2, the signal manipulator 120 is configured for manipulating the non-linear processed output signals 271-1, 271-2 using the spectral band replication parameter 121 of FIG. 1. It is exemplarily shown in FIG. 2 that at the output of the signal manipulator 120, the second group 219-2 of patched frequency subband signals will be obtained. In particular, the second group 219-2 of patched frequency subband signals may correspond to a first target frequency band (or first higher patch) generated from the core frequency band, wherein the first higher patch is based on a bandwidth extension factor (□) of two.

In addition, the non-linear processed output signals 273-1, 273-2 output by the first non-linear processing block 255-1 and the second non-linear processing block 255-2 may constitute the third group 219-3 of patched frequency subband signals received by the QMF synthesis filterbank 220. In particular, the third group 219-3 of patched frequency subband signals may correspond to a second target frequency band (or second higher patch) generated from the core frequency band, wherein the second target frequency band is based on a bandwidth extension factor (□) of three.

Referring to the embodiment of FIG. 2, a non-linear processed output signal for a higher patch (e.g., the non-linear processed output signal 271-2) and a non-linear processed output signal for a different higher patch (e.g., the non-linear processed output signal 273-1) can be added together or combined, as it is indicated in FIG. 2 by a dashed line 211.

Specifically, by providing the patch generator 110 shown in FIG. 2, it is possible to generate the bandwidth extended signal 135 using the first group 219-1 of patched frequency subband signals corresponding to the core frequency band, the second group 219-2 of patched frequency subband signals corresponding to the first higher patch and the third group 219-3 of patched frequency subband signals corresponding to the second higher patch.

Figure 3:
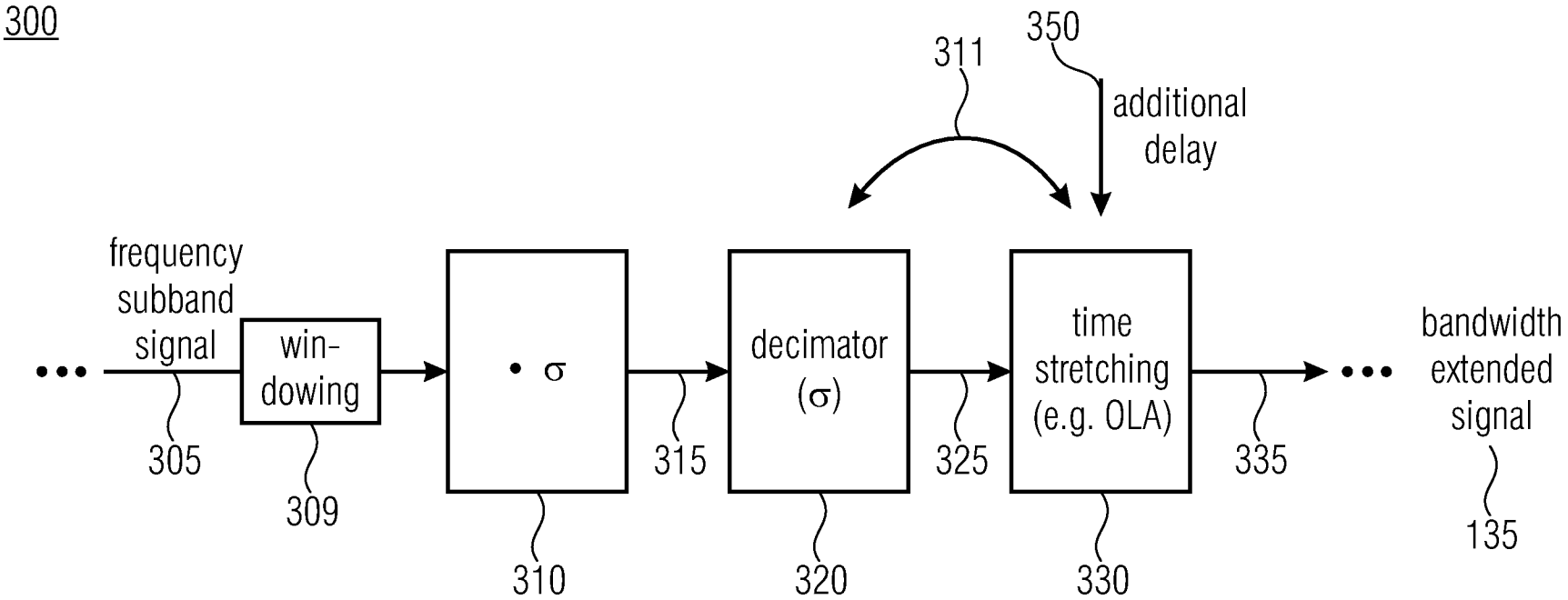
FIG. 3 shows a block diagram of an exemplary implementation of a non-linear processing block of the embodiment of the patch generator in accordance with FIG. 2.

FIG. 3 shows a block diagram of an exemplary implementation of a non-linear processing block 300 of the embodiment of the patch generator 110 in accordance with FIG. 2. The non-linear processing block 300 shown in FIG. 3 may correspond to one of the non-linear processing blocks 250 shown in FIG. 2. In the exemplary implementation of FIG. 3, the non-linear processing block 300 comprises a windowing block 309, a phase multiplication block 310, a decimator 320 and a time stretching unit 330 (e.g., using an overlap add (OLA) stage). For example, the phase multiplication block 310 is configured for multiplying a phase of a frequency subband signal 305 by a bandwidth extension factor (□) to obtain a phase multiplied frequency subband signal 315. Furthermore, the decimator 320 may be configured for decimating the phase multiplied frequency subband signal 315 to obtain a decimated frequency subband signal 325. Furthermore, the time stretching unit 330 may be configured for time stretching the decimated frequency subband signal 325 to obtain a time stretched output signal 335 which is temporally spread in time. Advantageously, block 330 performs an overlap add processing with a larger hopsize than used in windowing in block 309 so as to obtain a time-stretching operation. The frequency subband signal 305 input to the phase multiplication block 310 shown in FIG. 3 may correspond to one of the frequency subband signals 215 input to the patch generator 110 shown in FIG. 2, while the time stretched output signal 335 provided by the time stretching unit 330 shown in FIG. 3 may correspond to the non-linear processed output signal provided by one of the non-linear processing blocks 250 of the patch generator 110 shown in FIG. 2. Specifically, the time stretched output signal 335 can be manipulated by using a signal manipulation, such that the bandwidth extended signal 135 will be obtained.

In the exemplary implementation of FIG. 3, the phase multiplication block 310 may be implemented to be operative on the frequency subband signal 305 using the bandwidth extension factor (σ). For example, the bandwidth extension factor σ=2 and σ=3 can be used to provide the first higher patch and the second higher patch for the bandwidth extended signal 135, respectively, as described with reference to FIG. 2. Furthermore, the decimator 320 of the non-linear processing block 300 shown in FIG. 3 may be implemented by a sample rate converter for converting the sample rate of the phase multiplied frequency subband signal 315 in dependence on the bandwidth extension factor (σ). If, for example, a bandwidth extension factor σ=2 is used by the decimator 320, every second sample of the phase multiplied frequency subband signal 315 will be removed from same. This leads to the case that the decimated signal 325 output by the decimator 320 is substantially characterised by half the time duration of the phase multiplied frequency subband signal 315 and having an extended bandwidth.

Furthermore, the time stretching unit 330 may be configured to perform a time stretching of the decimated frequency subband signal 325 by a time stretching factor of two (e.g., using an overlap add processing by the OLA stage), such that the time stretched output signal 335 output by the time stretching unit 330 will again have the original time duration of the frequency subband signal 305 input to the phase multiplication block 310.

In the exemplary implementation of FIG. 3, the decimator 320 and the time stretching unit 330 may also be arranged in a reverse order with respect to the signal processing direction. This is indicated in FIG. 3 by the double arrow 311. In case the time stretching unit 330 is provided before the decimator 320, the phase multiplied frequency subband signal 315 will first be stretched in time to obtain a time stretched signal and then decimated to provide a decimated output signal for the bandwidth extended signal. If, for example, the phase multiplied frequency subband signal 315 is first stretched in time by a time stretching factor of two, the time stretched signal will be characterised by twice the time duration of the phase multiplied frequency subband signal 315. The subsequent decimation by a corresponding decimation factor of two, for example, leads to the case that the decimated output signal will again have the original time duration of the frequency subband signal 305 input to the phase multiplication block 310 and having an extended bandwidth.

Referring to FIG. 3, it is pointed out here that in any case, the time stretching operation performed by the time stretching unit 330 using the overlap add processing results in an additional delay of the harmonic patching algorithm such as within the patch generator 110. This effect of the additional delay due to the time stretching operation within the harmonic patching algorithm is indicated in FIG. 3 by the arrow 350. However, embodiments of the present invention provide the advantage that this additional delay can effectively be compensated for by applying the harmonic patching algorithm to the timely preceding bandwidth limited time block (m−1) for obtaining the current bandwidth extended time block (m'), as described with reference to FIG. 1.

In embodiments referring to FIG. 3, the patch generator 110 may be configured for performing the harmonic patching algorithm using an overlap add processing between at least two bandwidth limited time blocks.

Figure 4:
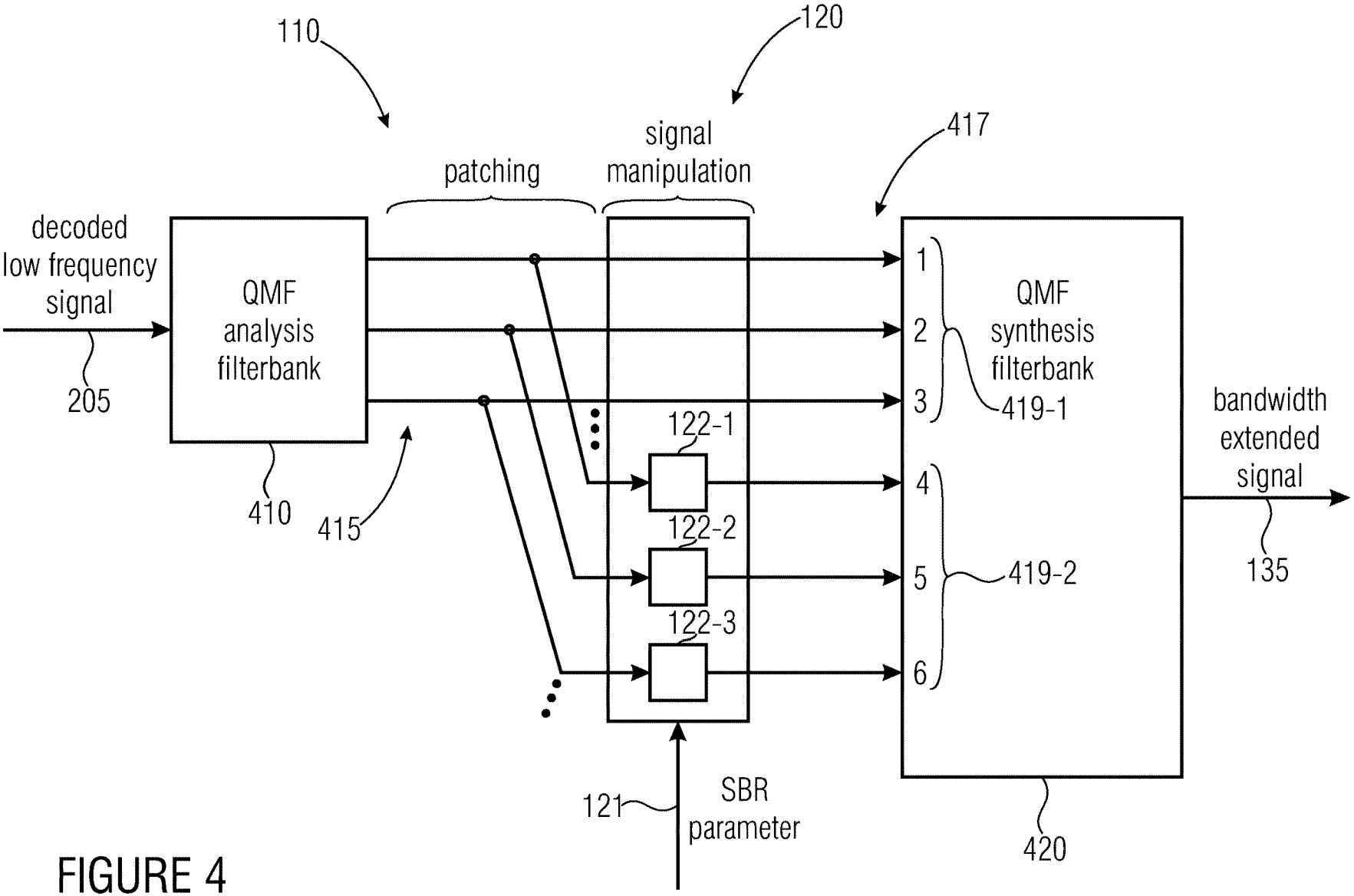
FIG. 4 shows a block diagram of an embodiment of a patch generator for performing a copy-up patching algorithm in a filterbank domain.

FIG. 4 shows a block diagram of an embodiment of a patch generator 110 for performing a copy-up patching algorithm in a filterbank domain. The patch generator 110 shown in FIG. 4 may be implemented in the apparatus 100 shown in FIG. 1. This means that in the apparatus 100 of FIG. 1, the patch generator 110 may be configured to perform, besides the harmonic patching algorithm described with reference to FIG. 2, the copy-up patching algorithm to be described with reference to FIG. 4.

Referring to the embodiment of FIG. 4, the apparatus 100 may comprise a QMF analysis filterbank 410, the patch generator 110 indicated in the processing chain by "patching", the signal manipulator 120 indicated in the processing chain by "signal manipulation" and a QMF synthesis filterbank 420. For example, the QMF analysis filterbank 410 is configured for converting the decoded low frequency signal 205 into a plurality 415 of frequency subband signals. In addition, by the cooperation of the patch generator 110 and the signal manipulator 120, a plurality 417 of patched frequency subband signals may be provided for the QMF synthesis filterbank 420. The QMF synthesis filterbank 420, in turn, may be configured to convert the plurality 417 of patched frequency subband signals into the bandwidth extended signal 135.

In FIG. 4, the patched frequency subband signals 417 received by the QMF synthesis filterbank 420 are exemplarily denoted by "1", "2", . . . , "6" and may represent different patched frequency subband signals having increasingly higher frequencies.

Referring to the embodiment of FIG. 4, the patch generator 110 is configured for directly forwarding the plurality 415 of frequency subband signals for a first group 419-1 of patched frequency subband signals from the QMF analysis filterbank 410 to the QMF synthesis filterbank 420. It is to be noted that the target band does not have to be the first band of the LF region. The source region even more starts at a higher band number in typical cases. This particularly applies to items 1 and 4 in the FIG. 4

In addition, the patch generator 110 may be configured for branching off the frequency subband signals 415 provided by the QMF analysis filterbank 410 and forwarding them for a second group 419-2 of patched frequency subband signals received by the QMF synthesis filterbank 420. It is also exemplarily depicted in FIG. 4 that the signal manipulator 120 comprises a plurality of signal manipulation blocks 122-1, 122-2, 122-3 and is operative in dependence on the spectral band replication parameter 121. For example, the signal manipulation blocks 122-1, 122-2, 122-3 are configured for manipulating the patched frequency subband signals branched off from the plurality 415 of frequency subband signals provided by the QMF analysis filterbank 410 to obtain the second group 419-2 of patched frequency subband signals received by the QMF synthesis filterbank 420. In the embodiment of FIG. 4, the first group 419-1 of patched frequency subband signals obtained from the patch generator 110 may correspond to the core frequency band of the decoded low frequency signal 205 or the bandwidth extended signal 135, while the second group 419-2 of patched frequency subband signals obtained from the patch generator 110 may correspond to a first higher target frequency band (or first higher patch) of the bandwidth extended signal 135. In a similar way as implemented for the first higher target frequency band, a second higher target frequency band (or second higher patch) can be generated by the cooperation of the patch generator 110 and the signal manipulator 120 shown in the embodiment of FIG. 4.

For example, the copy-up patching algorithm performed with the patch generator 110 in the filterbank domain as shown in the embodiment of FIG. 4 may represent a non-harmonic patching algorithm such as using a single sideband modulation (SSB).

Referring to the embodiment of FIG. 4, the QMF analysis filterbank 410 may be a 32-band analysis filterbank configured for providing, for example, 32 frequency subband signals 415. Furthermore, the QMF synthesis filterbank 420 may be a 64-band synthesis filterbank configured for receiving, for example, 64 patched frequency subband signals 417.

Specifically, the embodiment of the patch generator 110 shown in FIG. 4 can essentially be used to realize a high-efficiency advanced audio coding (HE-AAC) scheme such as defined in the MPEG-4 audio standard.

Figure 5A:
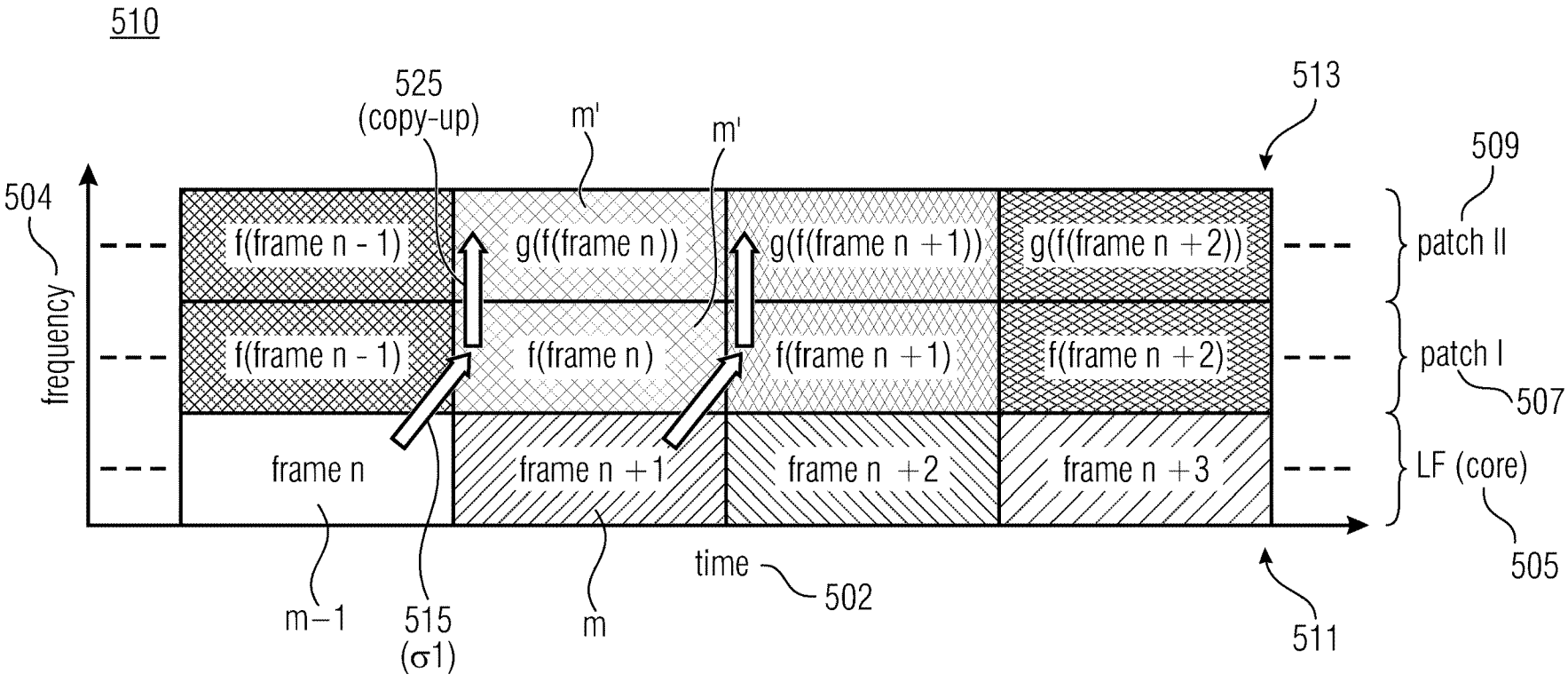
FIG. 5*a* shows a schematic illustration of an exemplary bandwidth extension scheme using a harmonic patching algorithm and a copy-up patching algorithm.

FIG. 5*a* shows a schematic illustration 510 of an exemplary bandwidth extension scheme using a harmonic patching algorithm 515 and a copy-up patching algorithm 525. In the schematic illustration 510 of FIG. 5*a*, the vertical axis (ordinate) indicates the frequency 504, while the horizontal axis (abscissa) indicates the time 502. In FIG. 5*a*, the plurality 511 of consecutive bandwidth limited time blocks is exemplarily depicted. The consecutive bandwidth limited time blocks 511 are exemplarily indicated in FIG. 5*a* by "frame n", "frame n+1", "frame n+2" and "frame n+3". The frequency content of the consecutive bandwidth limited time blocks 511 essentially represents the core frequency band or LF(core) 505. In addition, FIG. 5*a* exemplarily depicts the plurality 513 of consecutive bandwidth extended time blocks. The frequency content of the bandwidth extended time blocks 513 essentially corresponds to a first higher target frequency band (patch I 507) or a second higher target frequency band (patch II 509). The consecutive bandwidth extended time blocks 513 corresponding to patch I 507 are exemplarily denoted in FIG. 5*a* by "f(frame n−1)", "f(frame n)", "f(frame n+1)" and "f(frame n+2)". Furthermore, the consecutive bandwidth extended time blocks corresponding to patch II 509 are exemplarily denoted in FIG. 5*a* by "f(frame n−1)", "g(f(frame n))", "g(f(frame n+1))" and "g(f(frame n+2))". Here, the functional dependence f( . . . ) may indicate the application of the harmonic patching algorithm while the functional dependence g( . . . ) may indicate the application of the copy-up patching algorithm. In the schematic illustration 510 of FIG. 5*a*, the LF(core) 505 may be included within the bandwidth limited audio signal 105 and the patch I 507 and the patch II 509 may be included within the bandwidth extended signal 135 such as shown in the apparatus 100 of FIG. 1 Signal 135 also includes the LF (core), since it is indicated in the Figure to be at the output of the combiner. It has already been described with reference to FIG. 1 that each bandwidth limited time block has at least one associated spectral band replication parameter.

Figure 5B:
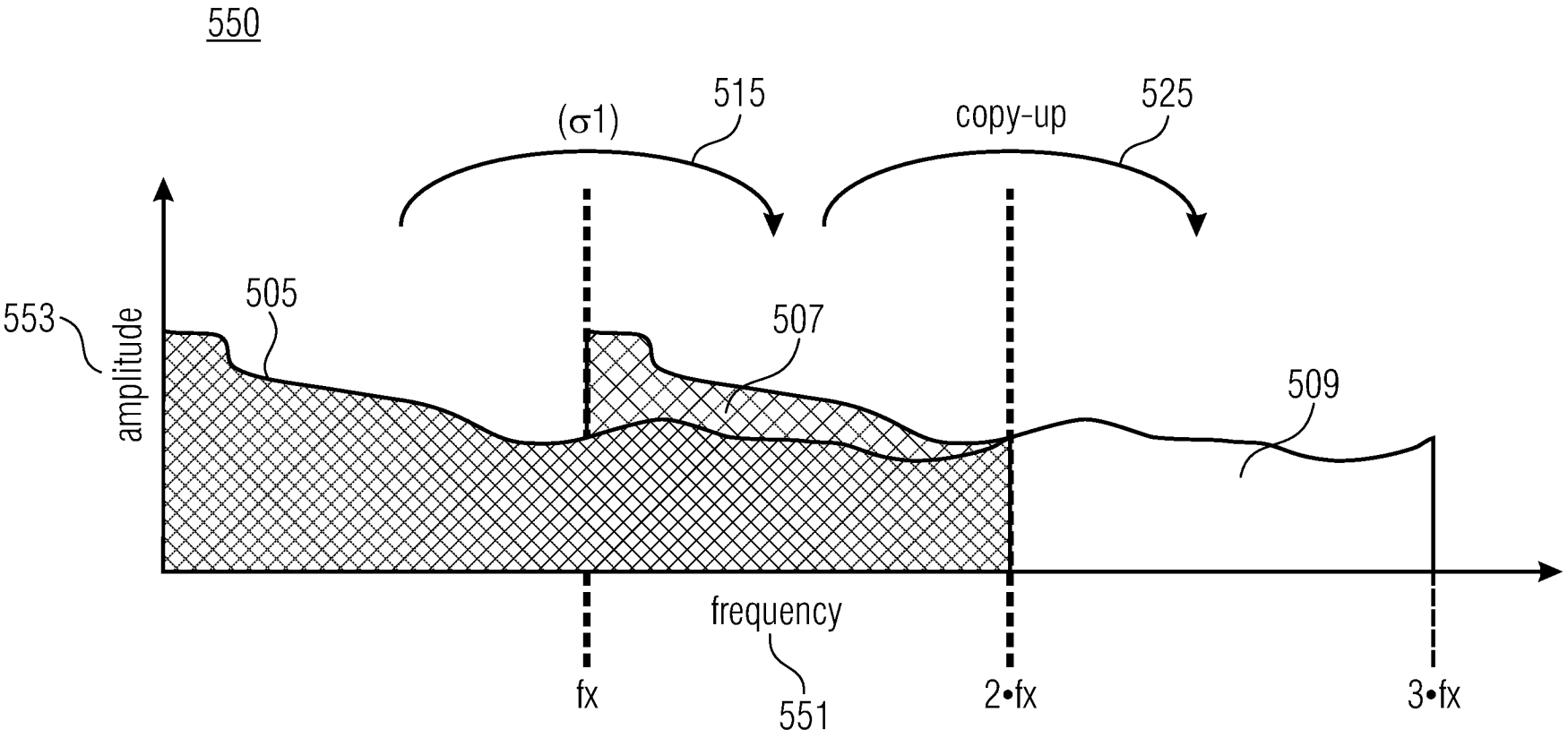
FIG. 5*b* shows an exemplary spectrum obtained from the bandwidth extension scheme of FIG. 5*a;*

FIG. 5*b* shows an exemplary spectrum 550 obtained from the bandwidth extension scheme of FIG. 5*a*. In FIG. 5*b*, the vertical axis (ordinate) corresponds to the amplitude 553, while the horizontal axis (abscissa) corresponds to the frequency 551 of the spectrum 550. It is exemplarily depicted in FIG. 5*b* that the spectrum 550 comprises the core frequency band or LF(core) 505, the first higher target frequency band or patch 1507 and the second higher target frequency band or patch II 509. In addition, the crossover frequency (fx), twice the crossover frequency (2·fx) and three times the crossover frequency (3·fx) are exemplarily depicted on the frequency axis of the spectrum 550.

In embodiments referring to FIGS. 1, 5*a* and 5*b*, the patch generator 110 may be configured for applying the harmonic patching algorithm 515 to the timely preceding bandwidth limited time block (m−1) using a bandwidth extension factor (al) of two. Furthermore, the patch generator 110 may be configured for generating from the core frequency band 505 of the timely preceding bandwidth limited time block (m−1) a first target frequency band 507 of the current bandwidth extended time block (m'). Furthermore, the patch generator 110 may be configured for applying the copy-up patching algorithm 525 for copying up the first target frequency band 507 of the current bandwidth extended time block (m') generated from the core frequency band 505 of the timely preceding bandwidth limited time block (m−1) to the second target frequency band 509 of the current bandwidth extended time block (m'). In FIG. 5*a*, the harmonic patching algorithm 515 is indicated by an inclined arrow, while the copy-up patching algorithm 525 is indicated by a non-inclined arrow.

As exemplarily depicted in the spectrum 550 of FIG. 5*b*, the core frequency band 505 may comprise frequencies ranging to the crossover frequency (fx). Furthermore, by applying the harmonic patching algorithm 515 using the exemplary bandwidth extension factor $\sigma 1=2$, the first target frequency band 507 comprising frequencies ranging from the crossover frequency (fx) to twice the crossover frequency (2·fx) will be obtained. Furthermore, by applying the copy-up patching algorithm 525, the second target frequency band 509 comprising frequencies ranging from twice the crossover frequency (2·fx) to three times the crossover frequency (3·fx) will be obtained.

Figure 6A:
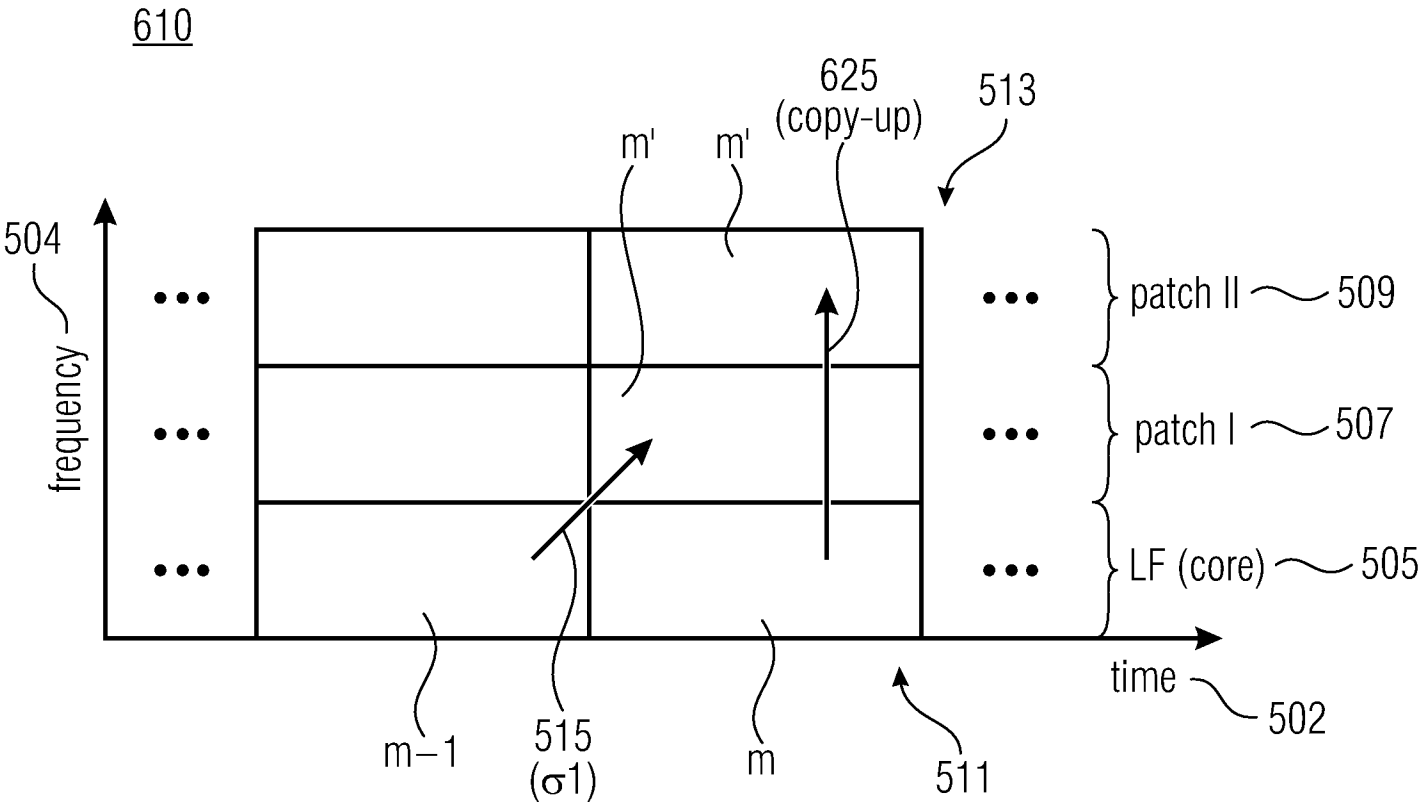
FIG. 6*a* shows a further schematic illustration of an exemplary bandwidth extension scheme using a harmonic patching algorithm and a copy-up patching algorithm.
Figure 6B:
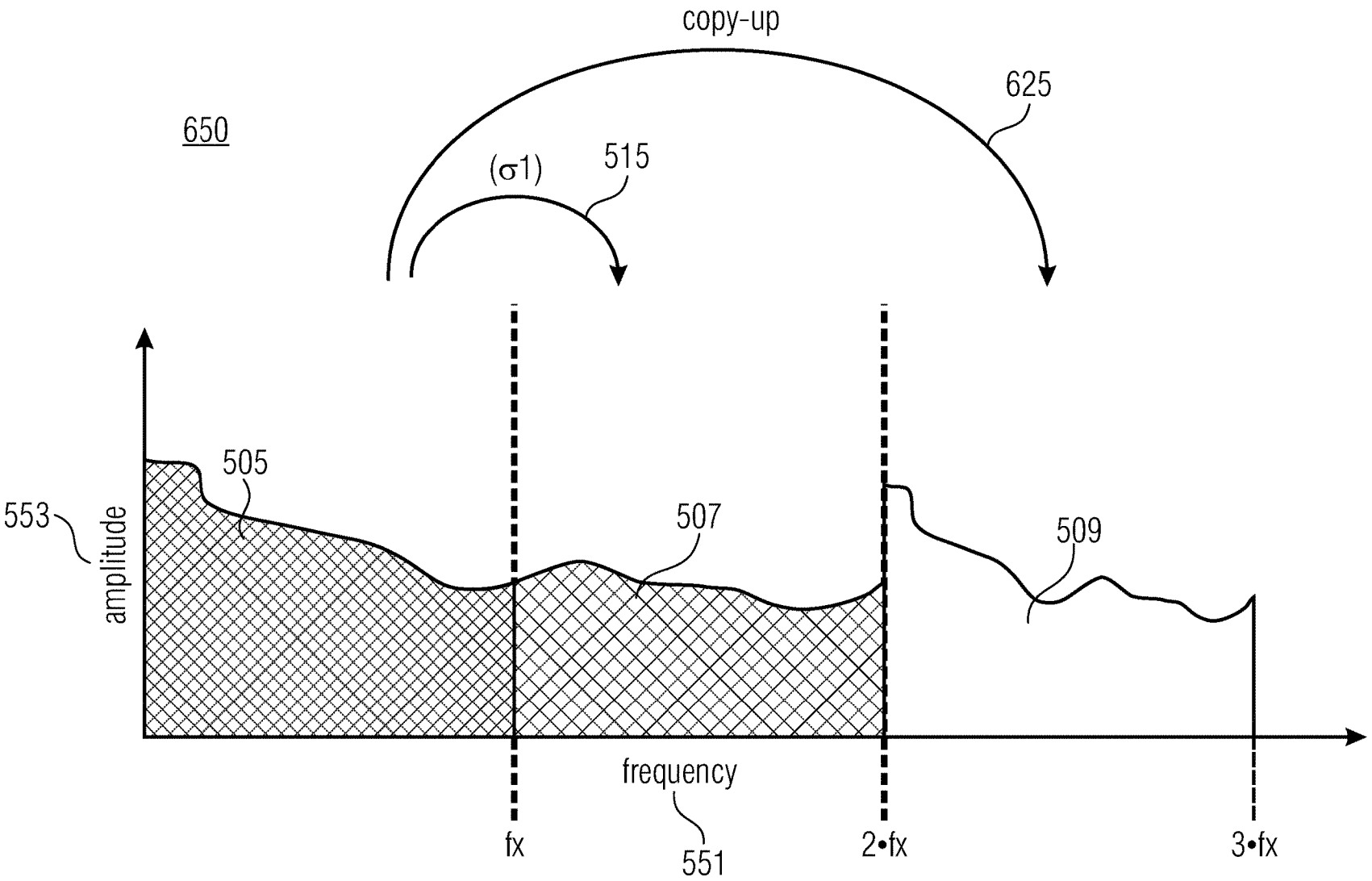
FIG. 6*b* shows an exemplary spectrum obtained from the bandwidth extension scheme of FIG. 6*a*

FIG. 6*a* shows a further schematic illustration of an exemplary bandwidth extension scheme using a harmonic patching algorithm 515 and a copy-up patching algorithm 625. FIG. 6*b* shows an exemplary spectrum 650 obtained from the bandwidth extension scheme of FIG. 6*a*. The elements 504, 502, 511, 513, 505, 507, 509 and 515 in the schematic illustration 610 of FIG. 6*a* and the elements 553, 551, 505, 507, 509 and 515 in the exemplary spectrum 650 of FIG. 6*b* may correspond to the elements with the same numerals in the schematic illustration 510 of FIG. 5*a* and the exemplary spectrum 550 of FIG. 5*b*. Therefore, a repeated description of these elements is omitted.

Referring to FIGS. 1, 6*a* and 6*b*, the patch generator 110 may be configured for applying the harmonic patching algorithm 515 to the timely preceding bandwidth limited time block (m−1) using a bandwidth extension factor ($\sigma 1$) of two. Furthermore, the patch generator 110 may be configured for generating from the core frequency band 505 of the timely preceding bandwidth limited time block (m−1) a first target frequency band 507 of the current bandwidth extended time block (m'). Furthermore, the patch generator 110 may be configured for applying the copy-up patching algorithm 625 for copying up the core frequency band 505 of the current bandwidth limited time block (m) to the second target frequency band 509 of the current bandwidth extended time block (m').

As exemplarily depicted in the spectrum 650 of FIG. 6*b*, the core frequency band 505 may comprise frequencies ranging up to the crossover frequency (fx), the first target frequency band 507 obtained from applying the harmonic patching algorithm 515 using the exemplary bandwidth extension factor σ1=2 may comprise frequencies ranging from the crossover frequency (fx) to twice the crossover frequency (2·fx), while the second target frequency band 509 obtained from applying the copy-up patching algorithm 625 may comprise frequencies ranging from twice the crossover frequency (2·fx) to three times the crossover frequency (3·fx).

Figure 7A:
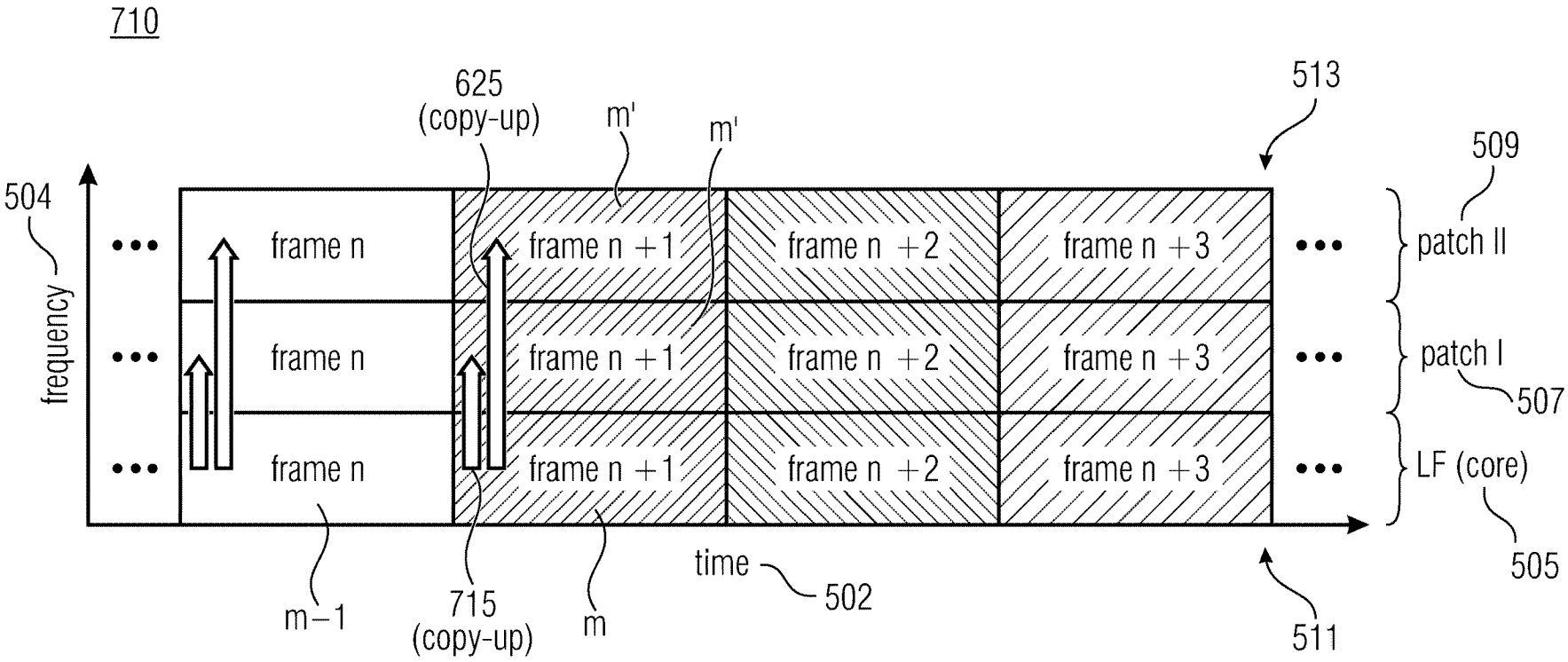
FIG. 7*a* shows a schematic illustration of an exemplary bandwidth extension scheme using a copy-up patching algorithm only.
Figure 7B:
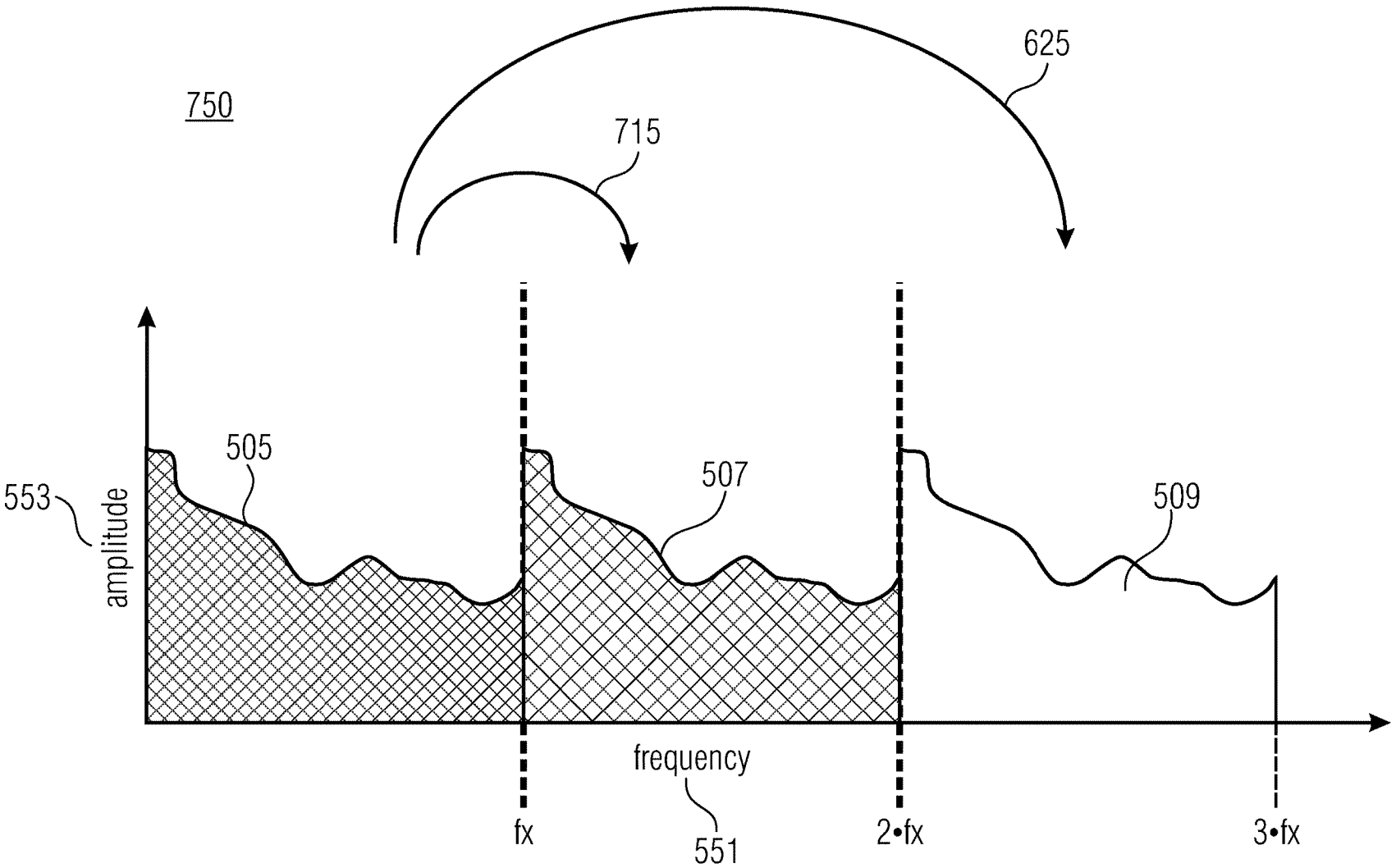
FIG. 7*b* shows an exemplary spectrum obtained from the bandwidth extension scheme of FIG. 7*a;*

FIG. 7*a* shows a schematic illustration 710 of an exemplary bandwidth extension scheme using a copy-up patching algorithm 715; 625 only. FIG. 7*b* shows an exemplary spectrum 750 obtained from the bandwidth extension scheme of FIG. 7*a*. The elements 504, 502, 511, 513, 505, 507, 509 in the schematic illustration 710 of FIG. 7*a* and the elements 553, 551, 505, 507, 509 in the exemplary spectrum 750 of FIG. 7*b* may correspond to the elements with the same numerals in the schematic illustration 510 of FIG. 5*a* and the exemplary spectrum 550 of FIG. 5*b*, respectively. Therefore, a repeated description of these elements is omitted.

Referring to FIGS. 1, 7*a* and 7*b*, the patch generator 110 may be configured for applying the copy-up patching algorithm 715 for copying up the core frequency band 505 of the current bandwidth limited time block (m) to the first target frequency band 507 of the current bandwidth extended time block (m'). Furthermore, the patch generator 110 may be configured for applying the copy-up patching algorithm 625 for copying up the core frequency band 505 of the current bandwidth limited time block (m) to the second target frequency band 509 of the current bandwidth extended time block (m'). In a similar way, such copy-up patching algorithms may also be applied to the timely preceding bandwidth limited time block (m−1) (see, e.g., FIG. 7*a*).

As exemplarily depicted in the spectrum 750 of FIG. 7*b*, the core frequency band 505 may comprise frequencies ranging up to the crossover frequency (fx), the first target frequency band 507 obtained from applying the copy-up patching algorithm 715 may comprise frequencies ranging from the crossover frequency (fx) to twice the crossover frequency (2·fx), while the second target frequency band 509 obtained from applying the copy-up patching algorithm 625 may comprise frequencies ranging from twice the crossover frequency (2·fx) to three times the crossover frequency (3·fx).

Figure 8A:
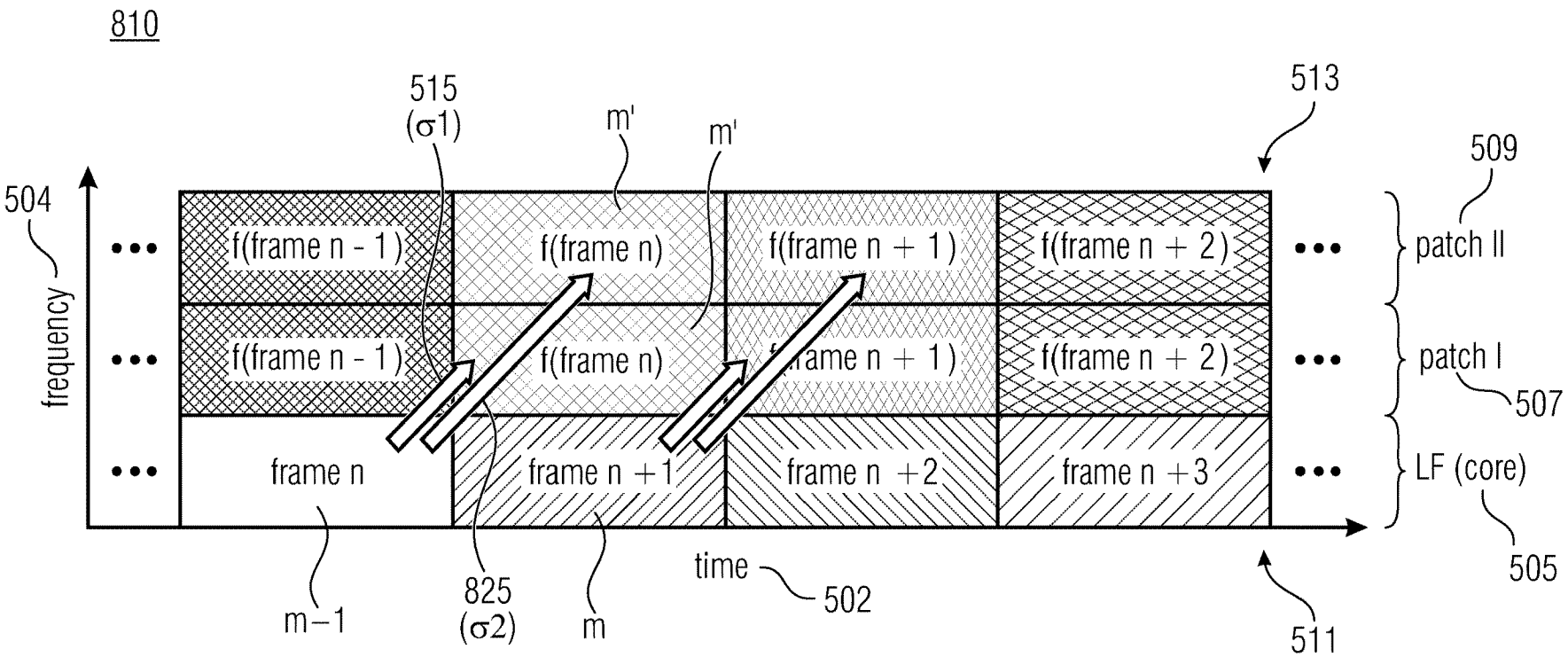
FIG. 8*a* shows a schematic illustration of an exemplary bandwidth extension scheme using a harmonic patching algorithm only.
Figure 8B:
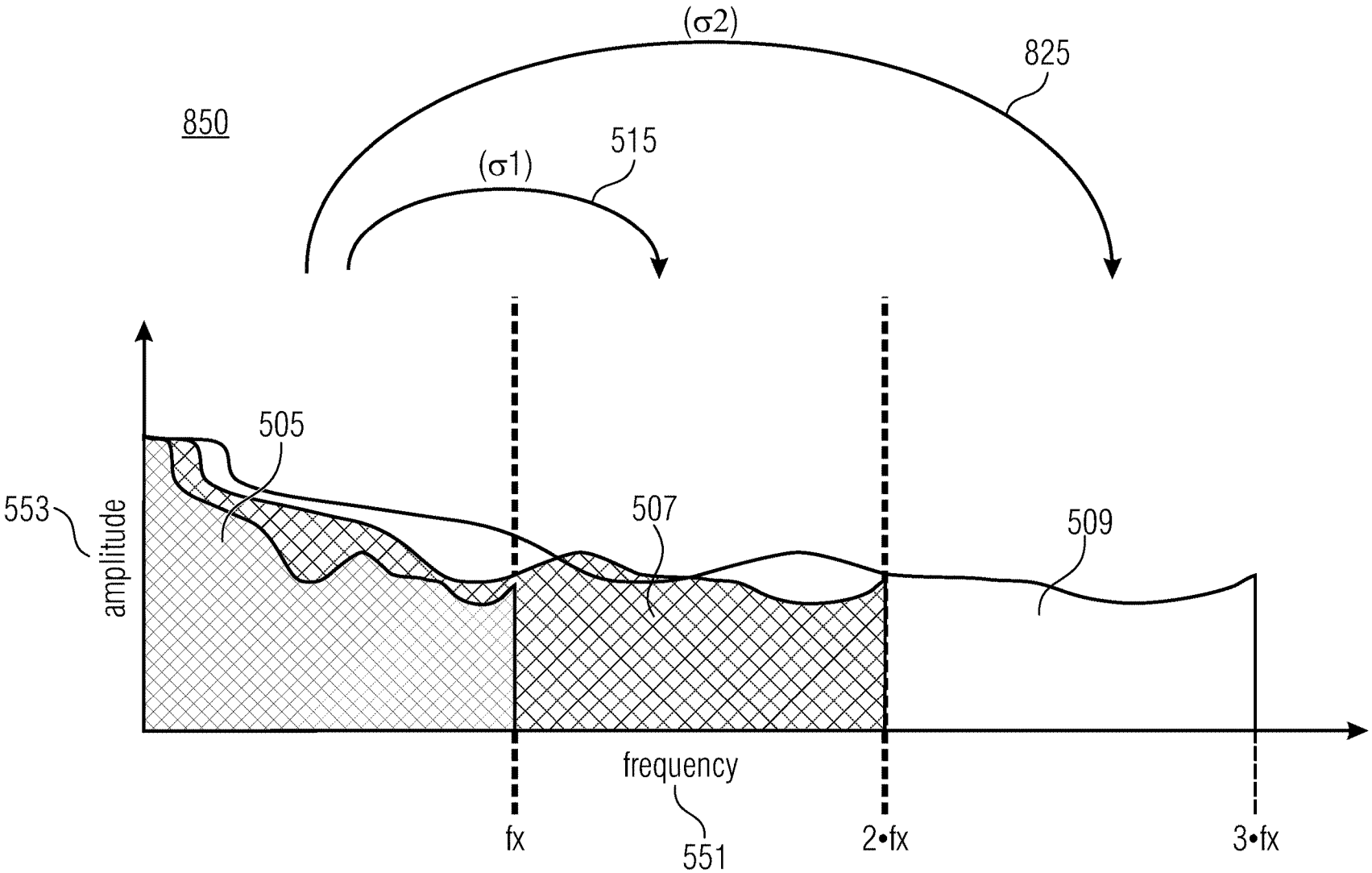
FIG. 8*b* shows an exemplarily spectrum obtained from the bandwidth extension scheme of FIG. 8*a;*

FIG. 8*a* shows a schematic illustration 810 of an exemplary bandwidth extension scheme using a harmonic patching algorithm 515; 825 only. FIG. 8*b* shows an exemplary spectrum 850 obtained from the bandwidth extension scheme of FIG. 8*a*. The elements 504, 502, 511, 513, 505, 507 and 509 in the schematic illustration 810 of FIG. 8*a* and the elements 553, 551, 505, 507 and 509 in the exemplary spectrum 850 of FIG. 8*b* may correspond to the elements with the same numerals shown in the schematic illustration 510 of FIG. 5*a* and the exemplary spectrum 550 of FIG. 5*b*, respectively. Therefore, a repeated description of these elements is omitted.

Referring to FIGS. 1, 8*a* and 8*b*, the patch generator 110 may be configured for applying the harmonic patching algorithm 825 to the timely preceding bandwidth limited time block (m−1) using a bandwidth extension factor (σ1) of two. Furthermore, the patch generator 110 may be configured for generating from the core frequency band 505 of the timely preceding bandwidth limited time block (m−1) a first target frequency band 507 of the current bandwidth extended time block (m'). Furthermore, the patch generator 110 may be configured for applying the harmonic patching algorithm 515 to the timely preceding bandwidth limited time block (m−1) using a bandwidth extension factor (σ2) of three. Furthermore, the patch generator 110 may be configured for generating from the core frequency band 505 of the timely preceding bandwidth limited time block (m−1) a second target frequency band 509 of the current bandwidth extended time block (m').

As exemplarily depicted in the spectrum 850 of FIG. 8*b*, the core frequency band 505 may comprise frequencies ranging up to the crossover frequency (fx), the first target frequency band 507 obtained from applying the harmonic patching algorithm 515 using the exemplary bandwidth extension factor σ1=2 may comprise frequencies ranging from the crossover frequency (fx) to twice the crossover frequency (2·fx), while the second target frequency band 509 obtained from applying the harmonic patching algorithm 825 using the exemplary bandwidth extension factor σ2=3 may comprise frequencies ranging from twice the crossover frequency (2−fx) to three times the crossover frequency (3−fx).

Figure 9:
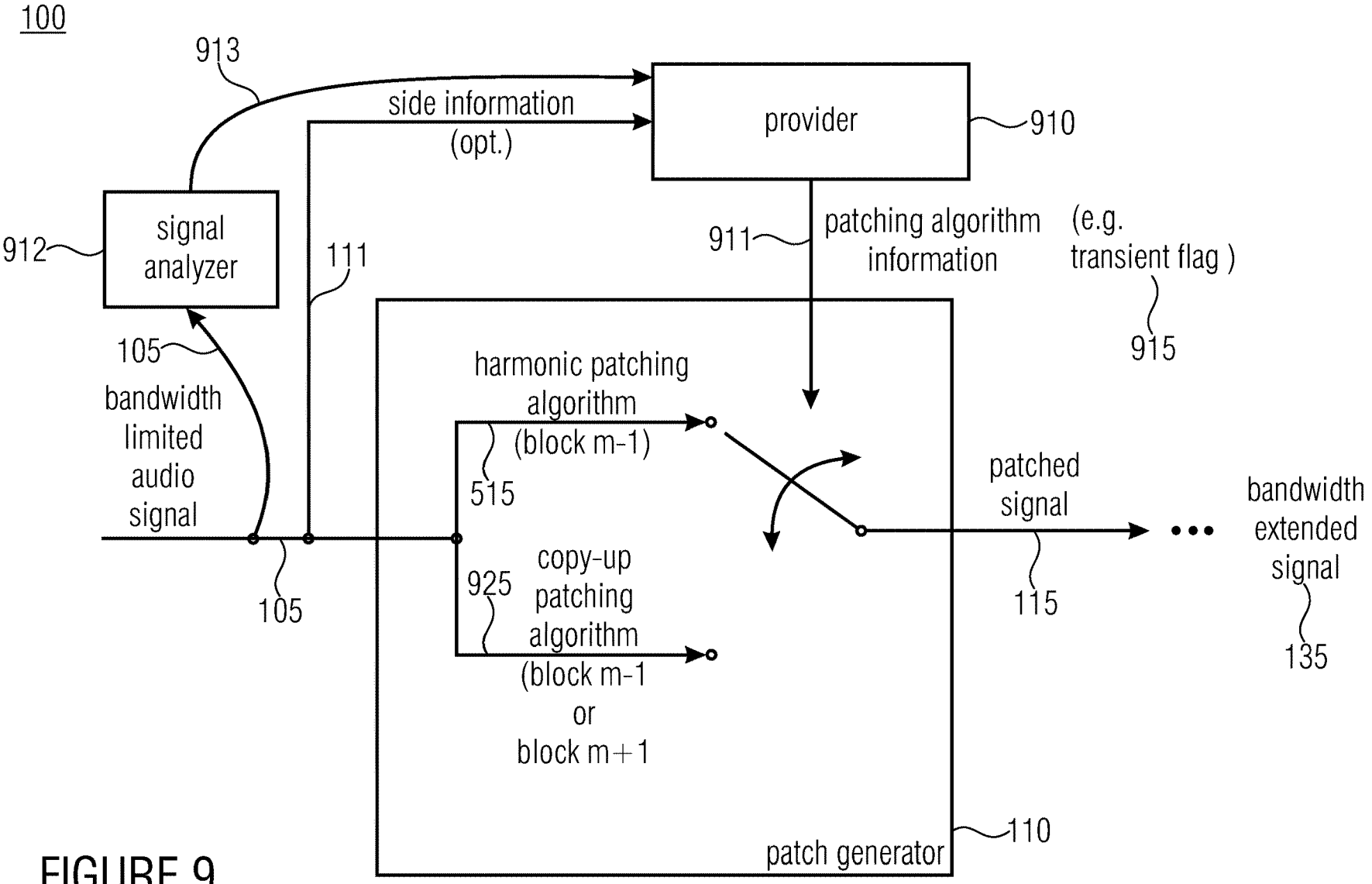
FIG. 9 shows a block diagram of an embodiment of a patch generator of the embodiment of the apparatus in accordance with FIG. 1.

FIG. 9 shows a block diagram of an embodiment of a patch generator 110 of the embodiment of the apparatus 100 in accordance with FIG. 1. As shown in FIG. 9, the apparatus 100 may further comprise a provider 910 for providing a patching algorithm information 911. In the embodiment of FIG. 9, the patch generator 110 may be configured for performing, besides the harmonic patching algorithm 515 using the timely preceding bandwidth limited time block (m−1), a copy-up patching algorithm 925 using the timely preceding bandwidth limited time block (m−1) or a timely succeeding bandwidth limited time block (m+1) for the corresponding preceding or succeeding blocks. In particular, the timely succeeding bandwidth limited time block (m+1) timely succeeds the current bandwidth limited time block (m). In the embodiment of FIG. 9, the patch generator 110 may furthermore be configured for using the patched signal 115 for the current bandwidth extended time block (m') generated from the harmonic patching algorithm 515 in response to the patching algorithm information 911.

Specifically, by providing the embodiment of the patch generator 110 shown in FIG. 9, it is possible to blockwise use different consecutive bandwidth extended time blocks for the bandwidth extended signal 135. Here, the blockwise use of the different consecutive bandwidth extended time blocks is essentially in response to the patching algorithm information 911.

In embodiments, the provider 910 may (optionally) be configured for providing the patching algorithm information 911 using a side information 111 encoded within the bandwidth limited audio signal 105. For example, the bandwidth limited audio signal 105 may be represented by an encoded audio signal (bitstream). The side information 111 which is received by the provider 910 may, for example, be extracted from the bitstream by using a bitstream parser.

Alternatively, the provider 910 may be configured for providing the patching algorithm information 911 in dependence on a signal analysis of the bandwidth limited audio signal 105. For example, the apparatus 100 may furthermore comprise a signal analyzer 912 configured to obtain an analysis result signal 913 for the provider 910 in dependence on a signal analysis of the bandwidth limited audio signal 105.

For example, the provider 910 may be configured for determining a transient flag 915 from each bandwidth limited time block of the bandwidth limited audio signal 105. In this case, the signal analyzer 912 may be included in the provider 910. Referring to the embodiment of FIG. 9, the patch generator 110 is configured for using the patched signal 115 for the current bandwidth extended time block (m') generated from the harmonic patching algorithm 515 when a stationarity of the bandwidth limited audio signal 105 is indicated by the transient flag 915. Furthermore, the patch generator 110 may be configured for using the patched signal 115 generated from the copy-up patching algorithm 925 when a non-stationarity of the bandwidth limited audio signal 105 is indicated by the transient flag 915.

For example, the stationarity of the bandwidth limited audio signal 105 (or the absence of a transient event in the bandwidth limited audio signal) may correspond to the transient flag 915 denoted by "0", while the non-stationarity of the bandwidth limited audio signal 105 (or the presence of the transient event in the bandwidth limited audio signal) may correspond to the transient flag 915 denoted by "1".

Figure 10:
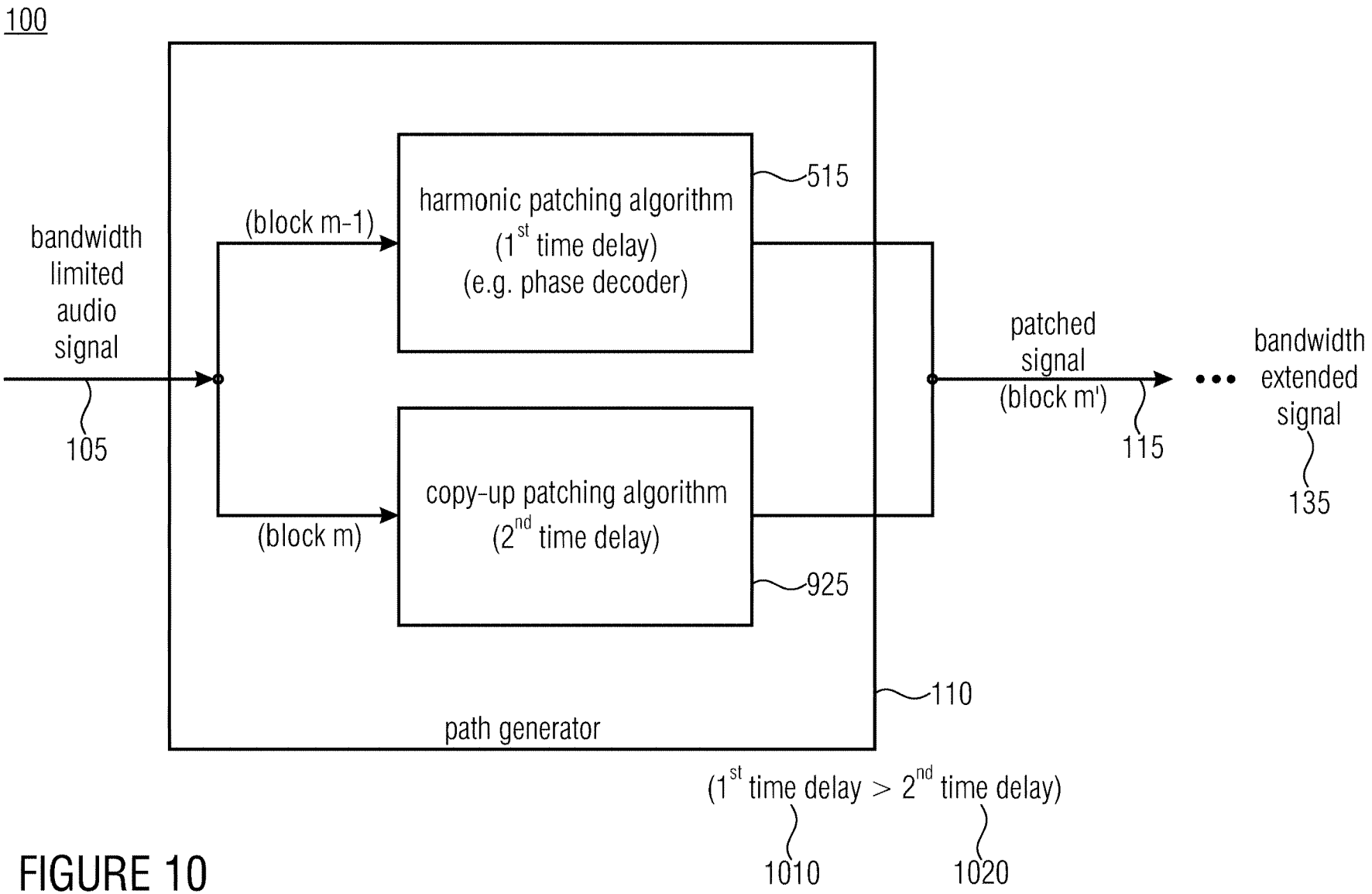
FIG. 10 shows a block diagram of a further embodiment of a patch generator of the embodiment of the apparatus in accordance with FIG. 1.

FIG. 10 shows a block diagram of a further embodiment of a patch generator 110 of the embodiment of the apparatus 100 in accordance with FIG. 1. According to the embodiment of FIG. 10, the patch generator 110 is configured for performing the harmonic patching algorithm 515 comprising a first time delay 1010 between the timely preceding bandwidth limited time block (m−1) and the current bandwidth extended time block (m'). Furthermore, the patch generator 110 may be configured for performing a copy-up patching algorithm 925 using the current bandwidth limited time block (m). In particular, the copy-up patching algorithm 925 comprises a second time delay 1020. Referring to the embodiment of FIG. 10, the first time delay 1010 of the harmonic patching algorithm 515 is larger than the second time delay 1020 of the copy-up patching algorithm 925.

For example, the patch generator 110 shown in FIG. 10 may comprise a phase vocoder for performing the harmonic patching algorithm 515 comprising the first time delay 1010. The phase vocoder may, in particular, be configured for using an overlap add processing between at least two bandwidth limited time blocks.

Figure 11:
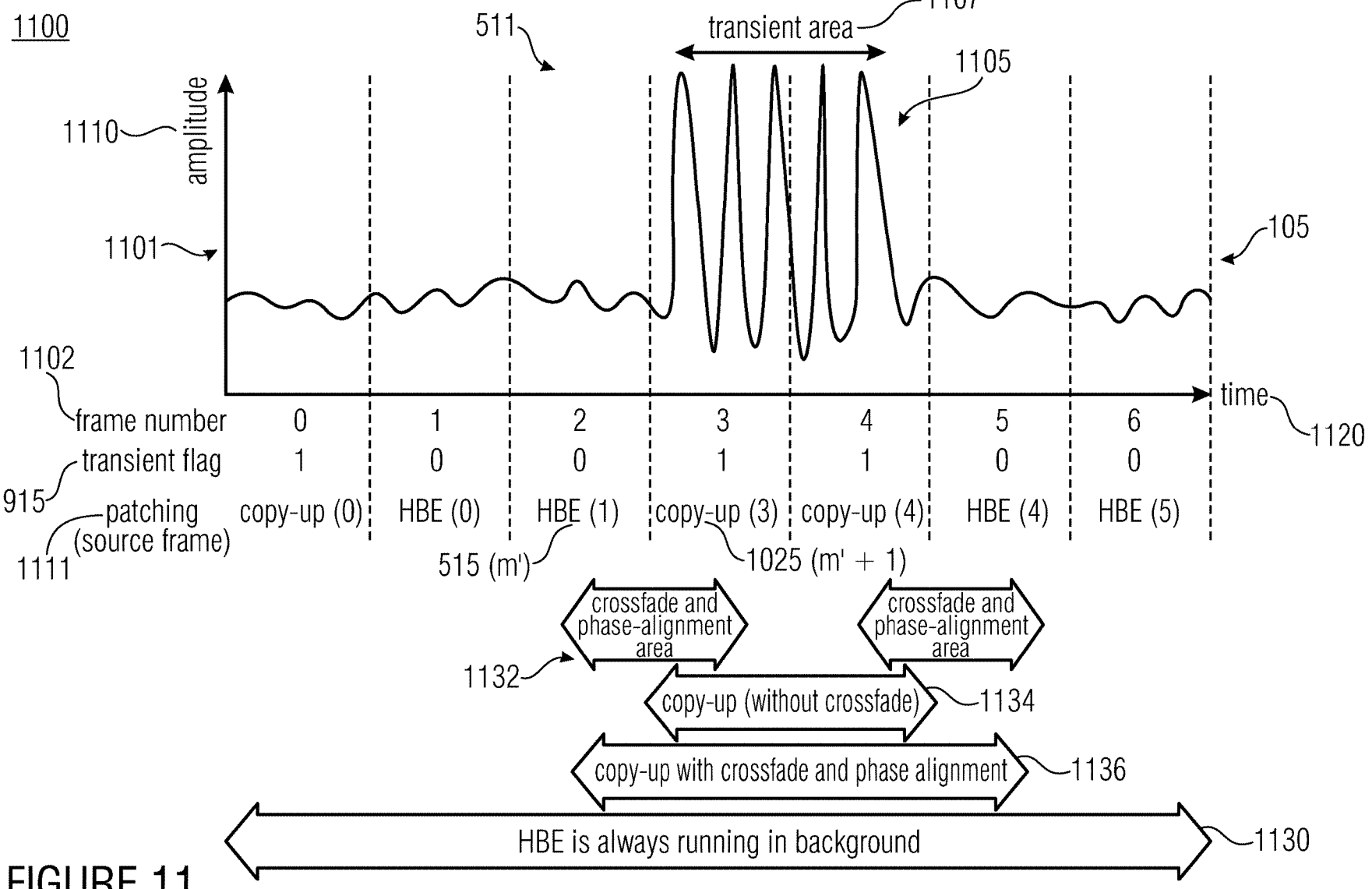
FIG. 11 shows a schematic illustration of an exemplarily patching scheme.

FIG. 11 shows a schematic illustration of an exemplary patching scheme 1100. The patching scheme 1100 of FIG. 11 is, for example, realized with the patch generator 110 shown in the apparatus 100 of FIG. 1. In FIG. 11, an exemplary graph 1101 of the bandwidth limited audio signal 105 is shown. As exemplarily depicted in the graph 1101, the bandwidth limited audio signal 105 comprises the plurality 511 of consecutive bandwidth limited time blocks comprising the core frequency band such as shown in the schematic illustration 510 of FIG. 5*a*. Furthermore, the vertical axis (ordinate) of the bandwidth limited audio signal 105 corresponds to the amplitude 1110, while the horizontal axis (abscissa) of the graph 1101 corresponds to the time 1120.

In FIG. 11, the consecutive bandwidth limited time blocks 511 are indicated by a corresponding frame number 1102 ("0", "1", "2", . . . ), respectively. Furthermore, the consecutive bandwidth limited time blocks 511 may be indicated by a corresponding transient flag 915 (e.g., denoted by "1" or "0"), respectively, which can be determined from each bandwidth limited time block of the bandwidth limited audio signal 105, such as by using the provider 910 shown in FIG. 9. It is also exemplarily depicted in FIG. 11 that the bandwidth limited audio signal 105 may comprise a transient event 1105 in a transient area 1107. This exemplary transient event 1105 is, for example, detected by a transient detector.

Referring to the schematic illustration 1100 of FIG. 11, the patch generator 110 may be configured for continuously applying the harmonic patching algorithm 515 to each bandwidth limited time block of the bandwidth limited audio signal 105. This is exemplarily depicted in FIG. 11 by the arrow 1130 denoted by "HBE is running in background".

According to another embodiment, the above-mentioned transient detector is configured for detecting the transient event 1105 in the bandwidth limited audio signal 105. For example, the patch generator 110 is configured for performing a copy-up patching algorithm 1025 when the transient event 1105 is detected in the bandwidth limited audio signal 105. Furthermore, the patch generator 110 may be configured for not performing the harmonic patching algorithm 515 using an overlap add processing between at least two bandwidth limited time blocks when the transient event 1105 is detected in the bandwidth limited audio signal 105. This essentially corresponds to an another situation, where in the transient area 1107 of the bandwidth limited audio signal 105, the copy-up patching algorithm 1025 is performed, while the harmonic patching algorithm is not running in the background.

Furthermore, FIG. 11 schematically illustrates the patching result 1111 of performing the respective patching algorithm for the plurality of consecutive bandwidth extended time blocks of the bandwidth extended signal 135. This patching result 1111 is indicated in FIG. 11 by "patching (source frame)". In particular, the patching result 1111 indicates the patched signal generated from the respective patching algorithm (i.e., the harmonic patching algorithm denoted by "HBE" or the copy-up patching algorithm denoted by "copy-up") which is applied to the corresponding bandwidth limited time block with the frame number 1102 (i.e., the source frame). The different bandwidth extended time blocks corresponding to the patching result 1111 may be further processed for increasing the perceptual quality of the bandwidth extended signal 135, as will be described in the context of FIG. 12.

Figure 12:
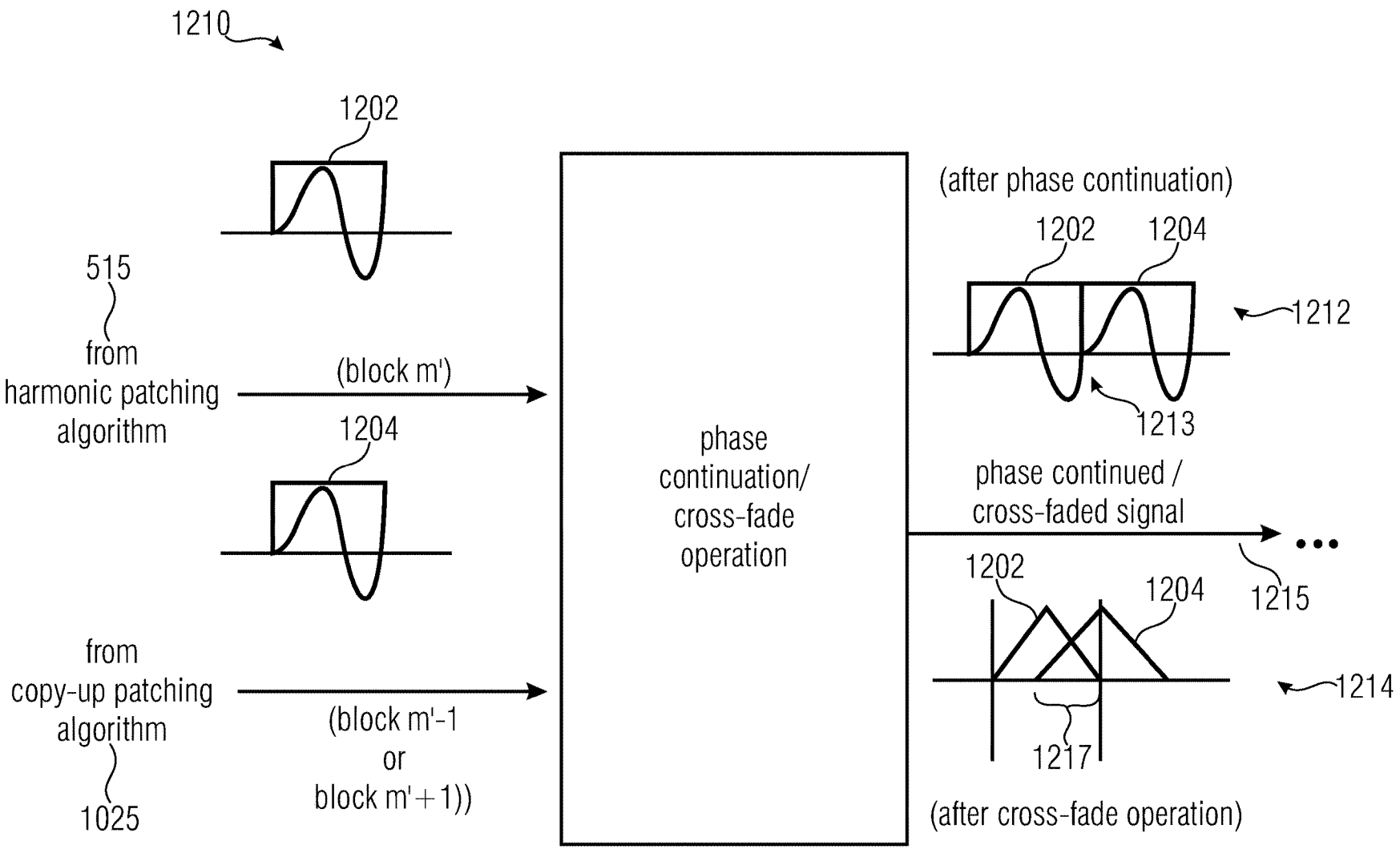
FIG. 12 shows an exemplarily implementation of a phase continuation/cross-fade operation between different bandwidth extended time blocks.

FIG. 12 shows an exemplary implementation of a phase continuation/cross-fade operation 1210 between different bandwidth extended time blocks 1202, 1204 obtained from the different patching algorithms such as illustrated in FIG. 11. Referring to FIGS. 11 and 12, the patch generator 110 may be configured for performing the harmonic patching algorithm 515 and the copy-up patching algorithm 1025. In particular, the block 1202 shown in FIG. 12 (obtained from the harmonic patching algorithm 515 illustrated in FIG. 11) may correspond to the current bandwidth extended time block (m'), while the block 1204 shown in FIG. 12 (obtained from the copy-up patching algorithm 1025 illustrated in FIG. 11) may correspond to a timely preceding bandwidth extended time block (m'−1) or a timely succeeding bandwidth extended time block (m'+1). Here, the timely preceding bandwidth extended time block (m'−1) timely precedes the current bandwidth extended time block (m'), and the timely succeeding bandwidth extended time block (m'+1) timely succeeds the current bandwidth extended time block (m').

According to FIG. 12, the patch generator 110 may be configured for performing a phase continuation 1210 between the current bandwidth extended time block (m')

generated from the harmonic patching algorithm 515 and the timely preceding bandwidth extended time block (m'−1) or the timely succeeding bandwidth extended time block (m'+1) 1204 generated from the copy-up patching algorithm 1025. As a result of the phase continuation 1210, a phase continued signal 1215 will be obtained. In FIG. 12, an exemplary signal 1212 obtained after the phase continuation is depicted. For example, the phase continuation 1210 is performed such that the current bandwidth extended time block (m') 1202 and the timely preceding bandwidth extended time block (m'−1) or the timely succeeding bandwidth extended time block (m'+1) 1204 comprise a smooth and continuous phase transition in a bordering region 1213 of same. For example, the phase continuation 1210 is performed such that an exemplary sinusoidal signal of the block 1204 comprises the same phase at its starting point as an exemplary sinusoidal signal of the previous block 1202 at its end point in the bordering region 1213. By performing the phase continuation 1210, it is possible to avoid a phase discontinuity or step in the phase continued signal 1215.

Furthermore, the patch generator 110 may be configured for performing a cross-fade operation 1210 between the current bandwidth extended time block (m') 1202 generated from the harmonic patching algorithm 515 and the timely preceding bandwidth extended time block (m'−1) or the timely succeeding bandwidth extended time block (m'+1) 1204 generated from the copy-up patching algorithm 1025 to obtain a cross-faded signal 1215.

As a result of the cross-fade operation 1210, the current bandwidth extended time block (m') 1202 and the timely preceding bandwidth extended time block (m'−1) or the timely succeeding bandwidth extended time block (m'+1) will at least partially overlap in a transition region 1217 of same. In FIG. 12, an exemplary signal 1214 obtained after the cross-fade operation is depicted. For example, the cross-fade operation 1210 is performed in that the starting region of each of the consecutive blocks 1202, 1204 is weighted by an exemplary weighting factor ranging from 0 to 1, the end region of each of the consecutive blocks 1202, 1204 is weighted by an exemplary weighting factor ranging from 1 to 0 and the two consecutive blocks 1202, 1204 are temporally overlapped in the transition region 1217 of same. The cross-fade area in this transition region 1217 may, for example, correspond to an overlap of the consecutive blocks 1202, 1204 of 50%. By performing the cross-fade operation 1210, it is possible to avoid clicking artefacts at the block borders and thus a degradation of the perceptual quality.

In the schematic illustration 1100 of FIG. 11, the phase continuation/cross-fade operation 1210 described with reference to FIG. 12 is exemplarily depicted by the arrows 1132 denoted by "crossfade and phase-alignment area". In particular, the arrows 1132 indicate that the phase continuation/cross-fade operation 1210 may be performed when a transition from the patched signal generated from the harmonic patching algorithm 515 to the patched signal generated from the copy-up patching algorithm 1025 corresponding to a transition from the non-transient area to the transient area 1107 in the bandwidth limited audio signal 105 (or vice versa) occurs. In this way, it is possible to avoid the degradation of the perceptual quality for the bandwidth extended signal 135 such as due to a phase discontinuation or clicking artefacts at the block borders.

It is also schematically depicted in FIG. 11 that during the transition between the bandwidth extended time blocks obtained from the same type of copy-up patching algorithm, the copy-up patching algorithm is continuously performed without the phase continuation/cross-fade operation 1210. This is exemplarily depicted in FIG. 11 by the arrow 1134 denoted by "copy-up (without crossfade)". This essentially corresponds to the case that the cross-fade operation is not performed for the bandwidth extended time blocks corresponding to the transient area 1107 of the bandwidth limited audio signal 105.

Furthermore, the arrow 1136 denoted by "copy-up with crossfade and phase alignment" is exemplarily depicted in FIG. 11. This arrow 1136 indicates that for the bandwidth extended time blocks corresponding to the transient area 1107, no phase continuation/cross-fade operation 1210 is performed (such as indicated by the arrow 1134), while in the transition region between the patched signal generated from the harmonic patching algorithm and the patched signal generated from the copy-up patching algorithm (i.e., when using patching algorithms of different type), the phase continuation/cross-fade operation 1210 is performed (such as indicated by the arrows 1132).

Figure 13:
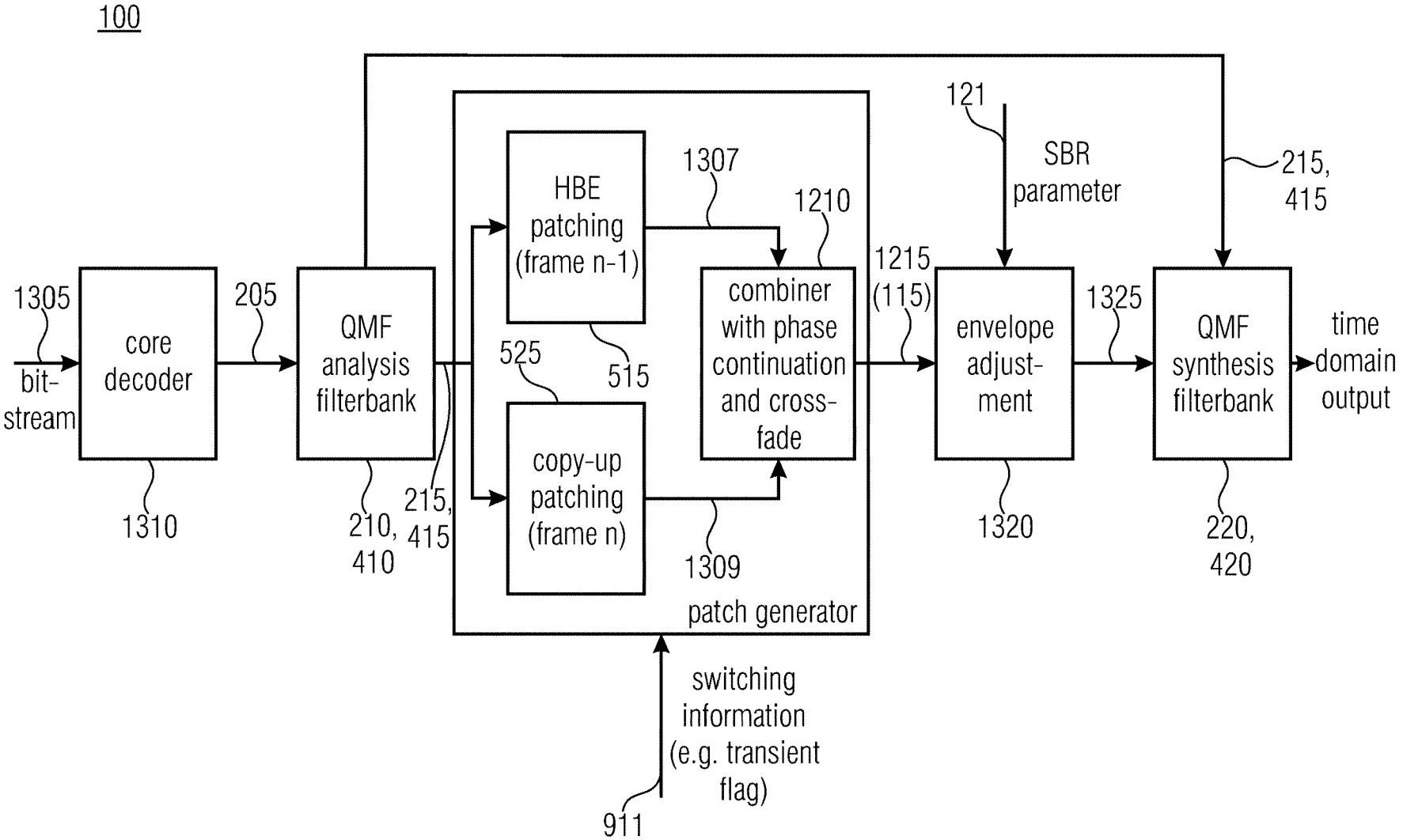
FIG. 13 shows a block diagram of a further embodiment of an apparatus for generating a bandwidth extended signal from a bandwidth limited audio signal.

FIG. 13 shows a block diagram of a further embodiment of an apparatus 100 for generating a bandwidth extended signal from a bandwidth limited audio signal. According to the embodiment of FIG. 13, the bandwidth extended signal may be represented by a time domain output 135, while the bandwidth limited audio signal may be represented by the plurality 215, 415 of frequency subband signals such as described with reference to FIGS. 2 and 4. In the embodiment of FIG. 13, the apparatus 100 comprises a core decoder 1310, the QMF analysis filterbank 210, 410 of FIGS. 2 and 4, the patch generator 110, an envelope adjustment unit 1320 and the QMF synthesis filterbank 220, 420 of FIGS. 2 and 4. Furthermore, the patch generator 110 shown in FIG. 13 comprises a first patching unit for performing the harmonic patching algorithm 515, a second patching unit for performing the copy-up patching algorithm 525 and a combiner for performing the phase continuation/cross-fade operation 1210 such as described with reference to FIG. 12.

In particular, the core decoder 1310 may be configured for providing the decoded low frequency signal 205 from a bitstream 1305 representing the bandwidth limited audio signal. The QMF analysis filterbank 210, 410 may be configured for converting the decoded low frequency signal 205 into the plurality 215, 415 of frequency subband signals. The first patching unit denoted by "HBE patching (frame n−1)" may be configured to be operative on the plurality 215, 415 of frequency subband signals to obtain a first patched signal 1307 using the timely preceding bandwidth limited time block (here denoted by frame n−1). Furthermore, the second patching unit of the patch generator 110 may be configured to be operative on the plurality 215, 415 of frequency subband signals to obtain a second patched signal 1309 using the current bandwidth limited time block (here denoted by frame n). Furthermore, the combiner of the patch generator 110 which is denoted by "combiner with phase continuation and crossfade" may be configured to combine the first patched signal 1307 and the second patched signal 1309 using the phase continuation/cross-fade operation 1210 for obtaining the phase continued/cross-faded signal 1215 representing the patched signal 115. Here, it is to be noted that the patch generator 110 shown in FIG. 13 may be configured to receive a switching information (e.g., a transient flag) corresponding to the patching algorithm information 911 as described in FIG. 9. For example, the patch generator 110 is configured to perform the harmonic patching algorithm 515 by the first patching unit when the transient flag indicates the stationarity of the bandwidth limited audio signal and to perform the copy-up patching algorithm 525 when the transient flag indicates the non-stationarity of the bandwidth limited audio signal. The envelope adjustment unit 1320 may be configured for adjusting the envelope of the phase continued/cross-faded signal 1215 provided by the patch generator 110 in dependence on the SBR parameter 121 to obtain an envelope adjusted signal 1325. Furthermore, the QMF synthesis filterbank 220, 420 may be configured for combining the envelope adjusted signal 1325 provided by the envelope adjustment unit 1320 and the plurality 215, 415 of frequency subband signals provided by the QMF analysis filterbank 210, 410 to obtain the time domain output 135 representing the bandwidth extended signal.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

The described embodiments are merely illustrative for the principles of the present invention. It is understood that modifications and variations of the arrangements and the details described herein will be apparent to others skilled in the art. It is the intent, therefore, to be limited only by the scope of the appending patent claims and not by the specific details presented by way of description and explanation of the embodiments herein.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Embodiments of the present invention provide a concept for a low delay harmonic bandwidth extension scheme for audio signals.

In summary, embodiments according to the present invention employ a mixed patching scheme which consists of the combination of SSB based patching and HBE based patching, whereupon the algorithmic delay of the phase vocoder based HBE is not compensated, i.e., HBE patching is delayed compared to the core coded LF part. Some embodiments according to the invention provide the application of a mixed patching method on a time block basis. According to some embodiments, SSB based patching should be applied in transient regions, where it is important to ensure vertical coherence over subbands, and HBE based patching should be used for stationary parts, where it is important to maintain the harmonic structure of the signal. Embodiments of the invention provide the advantage that due to the stationary nature of the tonal regions of the signal, the delay of the HBE based patching has no negative impact on the bandwidth extended signal, as the switching between both patching algorithms shall be controlled by means of a reliable signal dependent classification. For example, the patching algorithm for a given time block can be transmitted via bitstream. For full coverage of the different regions of the HF spectrum, a BWE (bandwidth extension) comprises, for example, several patches. For the SSB copy-up operation, the low frequency information can be used. In HBE, the higher patches can either be generated by multiple phase vocoders, or the patches of higher order that occupy the upper spectral regions can be generated by computationally efficient SSB copy-up patching and the lower order patches covering the middle spectral regions, for which the preservation of the harmonic structure is desired advantageously by HBE patching. The individual mix of patching methods can be static over time or, advantageously, be signaled in the bitstream.

Some algorithms of the novel patching exemplified for two patches are illustrated in FIGS. 7*a* and 8*a*. SSB and HBE can, however, be combined as described with reference to FIG. 5*a* (or FIG. 6*a*). The application of HBE is denoted as f(frame x). It is noteworthy that the HBE processing can be exchanged by other bandwidth extension techniques which take advantage of the stationarity of signals such as other overlap-and-add-methods.

Embodiments of the invention provide the advantage of an improved perceptual quality of stationary signal parts and a lower algorithmic delay compared to regular HBE patching.

The inventive processing is useful for enhancing audio codecs that rely on a bandwidth extension scheme. This processing is especially useful if an optimal perceptual quality at a given bitrate is highly important and, at the same time, a low overall system delay is necessitated.

Most prominent applications are audio decoders used for communication scenarios, which necessitate a very small time delay.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for generating a bandwidth extended signal from a bandwidth limited audio signal, the bandwidth limited audio signal comprising a plurality of consecutive bandwidth limited time blocks, each bandwidth limited time block comprising at least one associated spectral band replication parameter comprising a core frequency band and the bandwidth extended signal comprising a plurality of consecutive bandwidth extended time blocks, the apparatus comprising:

a patch generator for generating a patched signal comprising an upper frequency band using a bandwidth limited time block of the bandwidth limited audio signal;

wherein the patch generator is configured to perform a harmonic patching algorithm to acquire the patched signal;

wherein the apparatus is configured to acquire the bandwidth extended signal depending on the patched signal;

wherein the patch generator is configured to perform the harmonic patching algorithm for a current bandwidth extended time block of the plurality of consecutive bandwidth extended time blocks using a timely preceding bandwidth limited time block of the plurality of consecutive bandwidth limited time blocks of the bandwidth limited audio signal;

wherein the timely preceding bandwidth limited time block timely precedes the current bandwidth limited time block in the plurality of consecutive bandwidth limited time blocks of the bandwidth limited audio signal.

2. The apparatus in accordance with claim 1, wherein the patch generator is configured for performing the harmonic patching algorithm using an overlap add processing between at least two bandwidth limited time blocks.

3. The apparatus in accordance with claim 1, wherein the patch generator is configured for applying the harmonic patching algorithm to the timely preceding bandwidth limited time block using a bandwidth extension factor of two;

wherein the patch generator is configured for generating from the core frequency band of the timely preceding bandwidth limited time block a first target frequency band of the current bandwidth extended time block; and wherein the patch generator is configured for applying a copy-up patching algorithm for copying up the first target frequency band of the current bandwidth extended time block generated from the core frequency band of the timely preceding bandwidth limited time block to a second target frequency band of the current bandwidth extended time block.

4. The apparatus in accordance with claim 1, wherein the patch generator is configured for applying the harmonic patching algorithm to the timely preceding bandwidth limited time block using a bandwidth extension factor of two;

wherein the patch generator is configured for generating from the core frequency band of the timely preceding bandwidth limited time block a first target frequency band of the current bandwidth extended time block;

wherein the patch generator is configured for applying the harmonic patching algorithm to the timely preceding bandwidth limited time block using a bandwidth extension factor of three; and wherein the patch generator is configured for generating from the core frequency band of the timely preceding bandwidth limited time block a second target frequency band of the current bandwidth extended time block.

5. The apparatus in accordance with claim 1, wherein the patch generator is configured for continuously applying the harmonic patching algorithm to each bandwidth limited time block of the bandwidth limited audio signal.

6. The apparatus in accordance with claim 1, further comprising:

a provider for providing a patching algorithm information;

wherein the patch generator is configured for performing a copy-up patching algorithm for a timely preceding bandwidth extended time block using the timely preceding bandwidth limited time block or a timely succeeding bandwidth limited time block for a timely succeeding bandwidth extended time block, the timely succeeding bandwidth limited time block timely succeeding the current bandwidth limited time block;

wherein the patch generator is configured for using the patched signal for the current bandwidth extended time block generated from the harmonic patching algorithm in response to the patching algorithm information.

7. The apparatus in accordance with claim 6, wherein the provider is configured for providing the patching algorithm information using a side information encoded within the bandwidth limited audio signal.

8. The apparatus in accordance with claim 6, wherein the provider is configured for providing the patching algorithm information in dependence on a signal analysis of the bandwidth limited audio signal.

9. The apparatus in accordance with claim 7, wherein the provider is configured for determining a transient flag for each bandwidth limited time block of the bandwidth limited audio signal;

wherein the patch generator is configured for using the patched signal for the current bandwidth extended time block generated from the harmonic patching algorithm when a stationarity of the bandwidth limited audio signal is indicated by the transient flag; and wherein the patch generator is configured for using the patched signal generated from the copy-up patching algorithm when a non-stationarity of the bandwidth limited audio signal is indicated by the transient flag.

10. The apparatus in accordance with claim 1, wherein the patch generator is configured for performing the harmonic patching algorithm comprising a first time delay between the timely preceding bandwidth limited time block and the current bandwidth extended time block;

wherein the patch generator is configured for performing a copy-up patching algorithm using the current bandwidth limited time block, the copy-up patching algorithm comprising a second time delay;

wherein the first time delay of the harmonic patching algorithm is larger than the second time delay of the copy-up patching algorithm.

11. The apparatus in accordance with claim 10, wherein the patch generator comprises a phase vocoder for performing the harmonic patching algorithm comprising the first time delay; and wherein the phase vocoder is configured for using an overlap add processing between at least two bandwidth limited time blocks.

12. The apparatus in accordance with claim 1, further comprising:

a transient detector for detecting a transient event in the bandwidth limited audio signal;

wherein the patch generator is configured for performing a copy-up patching algorithm when the transient event is detected in the bandwidth limited audio signal; and wherein the patch generator is configured for not performing the harmonic patching algorithm using an overlap add processing between at least two bandwidth limited time blocks when the transient event is detected in the bandwidth limited audio signal.

13. The apparatus in accordance with claim 1, wherein the patch generator is configured for performing a copy-up patching algorithm; and wherein the patch generator is configured for performing a phase continuation between the current bandwidth extended time block generated from the harmonic patching algorithm and a timely preceding bandwidth extended time block or a timely succeeding bandwidth extended time block generated from the copy-up patching algorithm, the timely preceding bandwidth extended time block timely preceding the current bandwidth extended time block and the timely succeeding bandwidth extended time block timely succeeding the current bandwidth extended time block.

14. The apparatus in accordance with claim 1, wherein the patch generator is configured for performing a copy-up patching algorithm;

wherein the patch generator is configured for performing a cross-fade operation between the current bandwidth extended time block generated from the harmonic patching algorithm and a timely preceding bandwidth extended time block or a timely succeeding bandwidth extended time block generated from the copy-up patching algorithm, the timely preceding bandwidth extended time block timely preceding the current bandwidth extended time block and the timely succeeding bandwidth extended time block timely succeeding the current bandwidth extended time block, and wherein the current bandwidth extended time block and the timely preceding bandwidth extended time block or the timely succeeding bandwidth extended time block at least partially overlap in a transition region of same.

15. A method for generating a bandwidth extended signal from a bandwidth limited audio signal, the bandwidth limited audio signal comprising a plurality of consecutive bandwidth limited time blocks, each bandwidth limited time block comprising at least one associated spectral band replication parameter comprising a core frequency band and the bandwidth extended signal comprising a plurality of consecutive bandwidth extended time blocks, the method comprising;

generating a patched signal comprising an upper frequency band using a bandwidth limited time block of the bandwidth limited audio signal;

performing a harmonic patching algorithm to acquire the patched signal; and acquiring the bandwidth extended signal depending on the patched signal;

wherein performing the harmonic patching algorithm is conducted for a current bandwidth extended time block of the plurality of consecutive bandwidth extended time blocks using a timely preceding bandwidth limited time block of the plurality of consecutive bandwidth limited time blocks of the bandwidth limited audio signal;

wherein the timely preceding bandwidth limited time block timely precedes the current bandwidth limited time block in the plurality of consecutive bandwidth limited time blocks of the bandwidth limited audio signal.

16. A non-transitory computer-readable medium comprising a computer program comprising a program code for performing the method according to claim 15, when the computer program is executed on a computer.

* * * * *